US011526125B2

(12) United States Patent
Fukasawa

(10) Patent No.: US 11,526,125 B2
(45) Date of Patent: Dec. 13, 2022

(54) CARTRIDGE AND METHOD FOR DISASSEMBLING CARTRIDGE

(71) Applicant: CANON KABUSHIKI KAISHA, Tokyo (JP)

(72) Inventor: Yu Fukasawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/473,219

(22) Filed: Sep. 13, 2021

(65) Prior Publication Data

US 2022/0082995 A1 Mar. 17, 2022

(30) Foreign Application Priority Data

Sep. 16, 2020 (JP) ..... JP2020-155424

(51) Int. Cl.
*G03G 21/18* (2006.01)

(52) U.S. Cl.
CPC ..... *G03G 21/1857* (2013.01); *G03G 21/1814* (2013.01)

(58) Field of Classification Search
CPC ..... G03G 21/1814; G03G 21/1857
See application file for complete search history.

(56) References Cited

U.S. PATENT DOCUMENTS

2004/0091282 A1 5/2004 Yokoi
2006/0045565 A1 3/2006 Ueno
2006/0072938 A1 4/2006 Sato
2008/0138114 A1* 6/2008 Chadani ..... G03G 15/757 399/167
2008/0318748 A1* 12/2008 Akama ..... G03G 15/1685 492/56
2009/0238603 A1 9/2009 Kusudo
2010/0028042 A1 2/2010 Batori
2011/0013933 A1* 1/2011 Sato ..... G03G 15/0935 399/277
2013/0164029 A1 6/2013 Fukui
2019/0302684 A1 10/2019 Numata

FOREIGN PATENT DOCUMENTS

CN 106125532 A * 11/2016 ..... F16D 3/04
EP 3211484 A1 8/2017
EP 3550381 A1 10/2019
JP 2004151563 A * 5/2004 ..... G03G 21/1832
JP 2009288549 A 12/2009
JP 2019185022 A 10/2019

* cited by examiner

*Primary Examiner* — Sevan A Aydin
(74) *Attorney, Agent, or Firm* — Canon U.S.A., Inc. I.P. Division

(57) ABSTRACT

A cartridge includes a frame, a first side member, and a first fixing member. The frame includes a first end in a first direction, a first positioning portion disposed on the first end, and a first rotation stopping portion disposed on the first end. The first side member is attached to the first end and includes a first to-be-positioned portion to be engaged with the first positioning portion and a first rotation to-be-stopped portion to be engaged with the first rotation stopping portion. The first fixing member is fastened to the first positioning portion or the first rotation stopping portion. At least either one of (i) the first to-be-positioned portion and the first positioning portion and (ii) the first rotation to-be-stopped portion and the first rotation stopping portion are adhesively bonded.

14 Claims, 16 Drawing Sheets

CARTRIDGE AND METHOD FOR DISASSEMBLING CARTRIDGE

BACKGROUND

Field

The present disclosure relates to an electrophotographic image forming apparatus, such as a copying machine and a printer, using an electrophotographic method, and a cartridge for the electrophotographic image forming apparatus. The present disclosure also relates to a method for disassembling the cartridge.

Description of the Related Art

An electrophotographic image forming apparatus (hereinafter, also referred to as an "image forming apparatus") forms an image on a recording medium by an electrophotographic image forming method. Examples of the image forming apparatus include a copying machine, a facsimile apparatus, a printer (such as a laser beam printer and a light-emitting device (LED) printer), and a multifunction peripheral (multifunction printer) including aforementioned apparatuses.

A cartridge is detachably attached to a main body (apparatus main body) of an image forming apparatus. An example of the cartridge is a process cartridge into which a photosensitive member and at least one process unit acting on the photosensitive member are integrated.

A system utilizing the above mentioned cartridge significantly improves its maintainability since users can do maintenance of the image forming apparatus by themselves without a serviceperson. The cartridge system is thus widely used for image forming apparatuses.

Japanese Patent Application Laid-Open No. 2019-185022 describes a configuration where a unit (photosensitive member unit) including a photosensitive drum includes a frame and a support member for supporting the photosensitive drum. The support member is fixed to the frame by adhesives and screws.

SUMMARY

The present disclosure works towards preventing an increase in the size of a cartridge including a frame and a member fixed to the frame by adhesion while avoiding a positional deviation between the frame and the member fixed to the frame. The present disclosure is also directed towards providing a method for disassembling such a cartridge.

According to an aspect of the present disclosure, a cartridge includes a frame including a first end in a first direction, a first positioning portion disposed on the first end, and a first rotation stopping portion disposed on the first end, a first side member attached to the first end, wherein the first side member includes a first to-be-positioned portion configured to be engaged with the first positioning portion and a first rotation to-be-stopped portion configured to be engaged with the first rotation stopping portion, and wherein movement of the first side member in a direction intersecting the first direction is restricted by engagement of the first to-be-positioned portion with the first positioning portion, and rotation of the first side member about the first positioning portion is restricted by engagement of the first rotation to-be-stopped portion with the first rotation stopping portion, and a first fixing member fastened to the first positioning portion or the first rotation stopping portion, wherein the first fixing member is disposed to hold the first side member between the frame and the first fixing member, wherein at least either one of (i) the first to-be-positioned portion and the first positioning portion and (ii) the first rotation to-be-stopped portion and the first rotation stopping portion are adhesively bonded.

Further features of the present disclosure will become apparent from the following description of exemplary embodiments with reference to the attached drawings.

DESCRIPTION OF THE EMBODIMENTS

A mode for carrying out the present disclosure will be illustratively described in detail below with reference to the drawings and exemplary embodiments. Functions, materials, shapes, and relative arrangement of components described in the exemplary embodiments are not intended to limit the scope of the disclosure thereto unless otherwise specified.

A first exemplary embodiment will be described below with reference to the drawings.

In the following exemplary embodiment, an image forming apparatus to which four process cartridges can be detachably attached is described as an example of the image forming apparatus.

The number of process cartridges to be attached to the image forming apparatus is not limited thereto. The number of process cartridges to be attached is set as appropriate.

In the following exemplary embodiment, a laser beam printer is taken as an example of a mode of the image forming apparatus.

[Schematic Configuration of Image Forming Apparatus]

Figure 2:
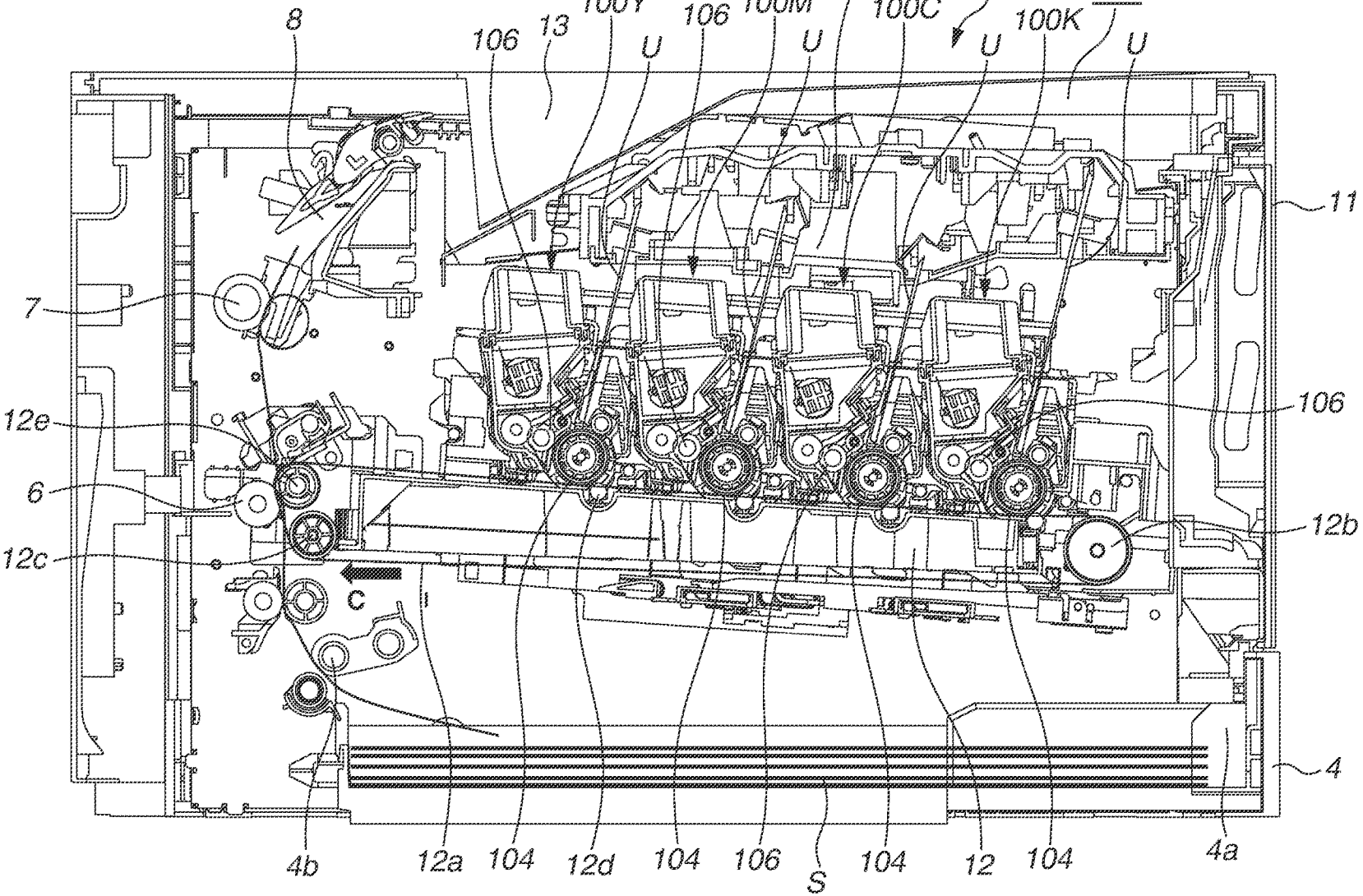
FIG. 2 is a schematic sectional view illustrating an image forming apparatus according to the first exemplary embodiment.
Figure 3:
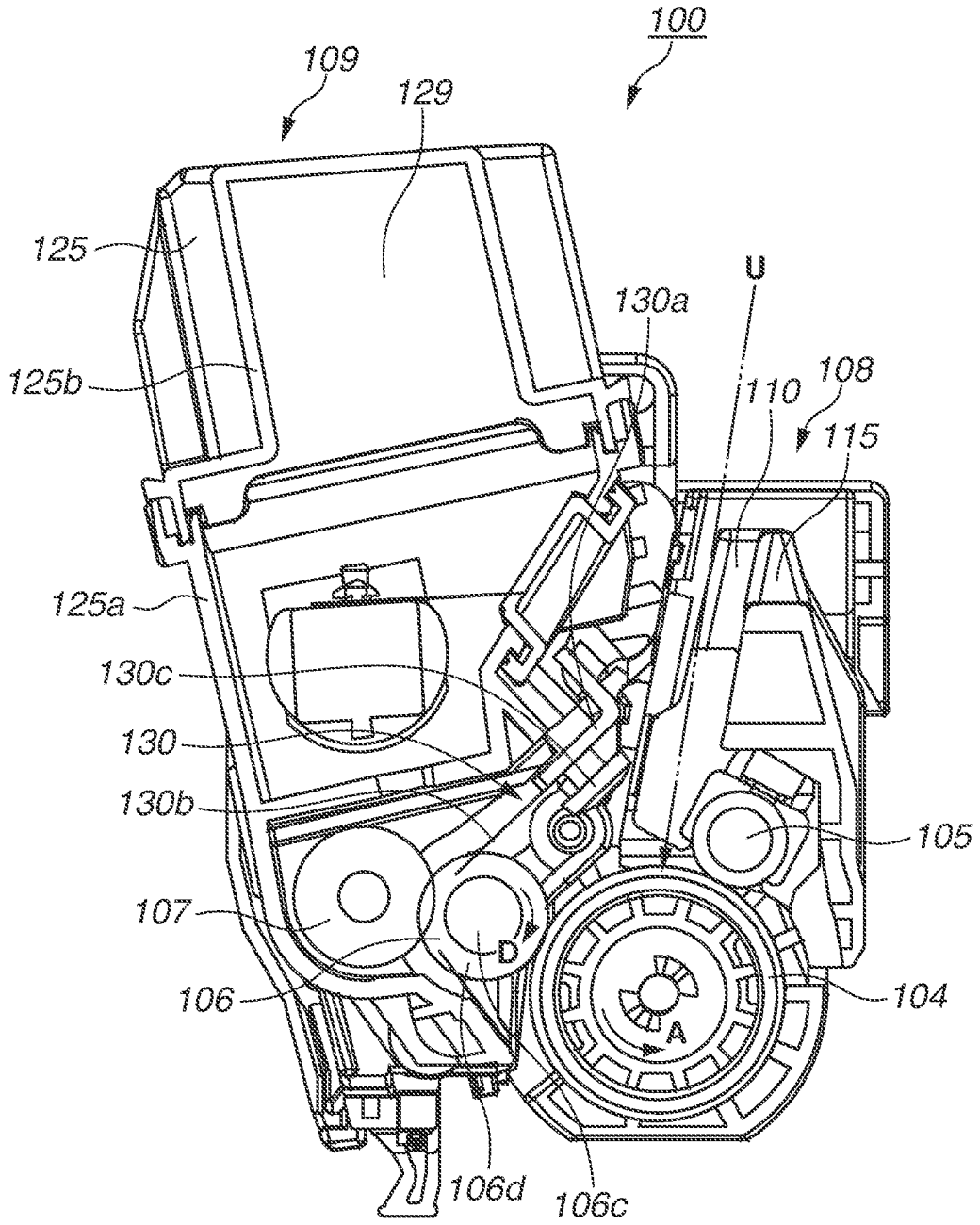
FIG. 3 is a sectional view illustrating a cartridge according to the first exemplary embodiment.

FIG. 2 is a schematic sectional view of an image forming apparatus M. FIG. 3 is a sectional view of a process cartridge (cartridge) 100.

The image forming apparatus M is a four-color full color laser printer using an electrophotographic process, and forms a color image on a recording medium S. The image forming apparatus M uses a process cartridge system, where the process cartridges 100 are detachably attached to an image forming apparatus main body (apparatus main body, electrophotographic image forming apparatus main body) 170 to form a color image on a recording medium S.

A side of the image forming apparatus M where a front door 11 is provided will be referred to as a front (front surface), and a side opposite to the front will be referred to as a rear (back surface). A right side and a left side when the image forming apparatus M is seen from the front will be referred to as a driving side and a non-driving side, respectively.

An upper side and a lower side when the image forming apparatus M is seen from the front will be referred to as a top and a bottom, respectively. FIG. 2 is a sectional view of the image forming apparatus M seen from the non-driving side. The near side of the drawing corresponds to the non-driving side of the image forming apparatus M, the right side of the drawing corresponds to the front of the image forming apparatus M, and the far side of the drawing corresponds to the driving side of the image forming apparatus M.

A driving side of the process cartridge 100 is where a drum coupling member (photosensitive member coupling member) to be described below is provided in an axial direction of a photosensitive drum to be described below. The driving side of the process cartridge 100 is also where a developing coupling member to be described below is provided in an axial direction of a developing roller (developing member) to be described below.

The axial direction of the photosensitive drum is a direction parallel to a rotation axis of the photosensitive drum to be described below. Similarly, the axial direction of the developing roller is a direction parallel to a rotation axis of the developing roller to be described below. In the present exemplary embodiment, the axis of the photosensitive drum and the axis of the developing roller are substantially parallel, and the axial direction of the photosensitive drum and the axial direction of the developing roller will thus be regarded as being substantially the same.

A first cartridge 100Y, a second cartridge 100M, a third cartridge 100C, and a fourth cartridge 100K are substantially horizontally disposed in the image forming apparatus main body 170.

The first to fourth cartridges 100 (100Y, 100M, 100C, and 100K) each include electrophotographic process mechanisms similar to each other, with developers (hereinafter, referred to as toner) of respective different colors. A rotational driving force is transmitted from a drive output unit of the image forming apparatus main body 170 to the first to fourth cartridges 100 (100Y, 100M, 100C, and 100K).

Bias voltages (such as a charging bias and a developing bias, not illustrated) are supplied from the image forming apparatus main body 170 to the first to fourth cartridges 100 (100Y, 100M, 100C, and 100K).

As illustrated in FIG. 3, each of the first to fourth cartridges 100 (100Y, 100M, 100C, and 100K) according to the present exemplary embodiment includes a photosensitive drum (photosensitive unit) 104 and a drum holding unit 108 including a charging unit serving as a process unit for acting on the photosensitive drum 104. Each of the first to fourth cartridges 100 (100Y, 100M, 100C, and 100K) includes a developing unit 109 including a developing roller (developing means) 106 for developing an electrostatic latent image on the photosensitive drum 104.

The drum holding unit 108 and the developing unit 109 are connected to each other. A more specific configuration of the cartridges 100 will be described below.

The first cartridge 100Y accommodates yellow (Y) toner in its developing frame 125, and forms a yellow toner image on the surface of its photosensitive drum 104.

The second cartridge 100M accommodates magenta (M) toner in its developing frame 125, and forms a magenta toner image on the surface of its photosensitive drum 104.

The third cartridge 100C accommodates cyan (C) toner in its developing frame 125, and forms a cyan toner image on the surface of its photosensitive drum 104.

The fourth cartridge 100K accommodates black (K) toner in its developing frame 125, and forms a black toner image on the surface of its photosensitive drum 104.

A laser scanner unit 14 serving as an exposure unit is disposed above the first to fourth cartridges 100 (100Y, 100M, 100C, and 100K). The laser scanner unit 14 outputs laser light U based on image information. The laser light U is then passed through exposure windows 110 of the cartridges 100 to scan and expose the surfaces of the photosensitive drums 104.

An intermediate transfer unit 12 serving as a transfer member is disposed under the first to fourth cartridges 100 (100Y, 100M, 100C, and 100K). The intermediate transfer unit 12 includes a driving roller 12*e*, a turn roller 12*c*, and a tension roller 12*b*. A transfer belt 12*a* having flexibility is stretched across the rollers 12*b*, 12*c*, and 12*e*.

The bottom surfaces of the photosensitive drums 104 of the first to fourth cartridges 100 (100Y, 100M, 100C, and 100K) are in contact with the top surface of the transfer belt 12*a*. The contacting portions are primary transfer portions. Primary transfer rollers 12*d*, provided along the inner surface of the transfer belt 12*a*, face the respective photosensitive drums 104 via the transfer belt 12*a*.

A secondary transfer roller 6 is in contact with the turn roller 12*c* via the transfer belt 12*a*. The contacting portion between the transfer belt 12*a* and the secondary transfer roller 6 is a secondary transfer portion.

A feed unit 4 is disposed under the intermediate transfer unit 12. The feed unit 4 includes a feed tray 4*a* accommodating a stack of recording media S, and a feed roller 4*b*.

A fixing device 7 and a sheet discharge device 8 are disposed in an upper left part of the image forming apparatus main body 170 in FIG. 2. A top surface of the image forming apparatus main body 170 serves as a sheet discharge tray 13.

A fixing unit included in the fixing device 7 fixes a toner image to a recording medium S, and the recording medium S is discharged to the sheet discharge tray 13.

[Image Forming Operation]

An operation for forming a full color image will now be described.

The photosensitive drums 104 of the first to fourth cartridges 100 (100Y, 100M, 100C, and 100K) are driven to rotate at a predetermined speed (in a direction of an arrow A in FIG. 3).

The transfer belt 12*a* is also driven to rotate in a forward direction of rotation of the photosensitive drums 104 (a direction of an arrow C in FIG. 2) at a speed corresponding to that of the photosensitive drums 104.

The laser scanner unit 14 is also driven. In the cartridges 100, charging rollers (charging members) 105 uniformly charge the surfaces of the photosensitive drums 104 with a predetermined polarity and potential in synchronization with the driving of the laser scanner unit 14. The laser scanner unit 14 scans and exposes the surfaces of the photosensitive drums 104 with the laser light U based on image signals of the corresponding colors.

This forms electrostatic latent images based on the image signals of the corresponding colors on the surfaces of the respective photosensitive drums 104. The formed electrostatic latent images are developed by the developing rollers 106 driven to rotate at a predetermined speed.

By the foregoing electrophotographic image forming process operation, a yellow toner image corresponding to a yellow component of a full color image is formed on the photosensitive drums 104 of the first cartridge 100Y. The toner image is then primarily transferred to the transfer belt 12*a*.

Similarly, a magenta toner image corresponding to a magenta component of the full color image is formed on the photosensitive drum 104 of the second cartridge 100M. The toner image is then primarily transferred and superimposed onto the yellow toner image already transferred to the transfer belt 12*a*.

Similarly, a cyan toner image corresponding to a cyan component of the full color image is formed on the photosensitive drum 104 of the third cartridge 100C. The toner image is then primarily transferred and superimposed onto the yellow and magenta toner images already transferred to the transfer belt 12*a*.

Similarly, a black toner image corresponding to a black component of the full color image is formed on the photosensitive drum 104 of the fourth cartridge 100K. The toner image is then primarily transferred and superimposed onto the yellow, magenta, and cyan toner images already transferred to the transfer belt 12*a*.

In such a manner, the yellow, magenta, cyan, and black, four-color full color unfixed toner images are formed on the transfer belt 12*a*.

Meanwhile, the recording media S are separated and fed one by one at a predetermined control timing. The fed recording medium S is guided into the secondary transfer portion that is the contacting portion between the secondary transfer roller 6 and the transfer belt 12*a* at a predetermined control timing.

The superimposed four-color toner images on the transfer belt 12*a* are thus sequentially and simultaneously transferred to a side of the recording medium S in the process of the recording medium S being conveyed through the secondary transfer portion.

The configuration of the image forming apparatus main body 170 will be described in more detail below.

[Overview of Cartridge Attaching and Detaching Configuration]

Figure 4:
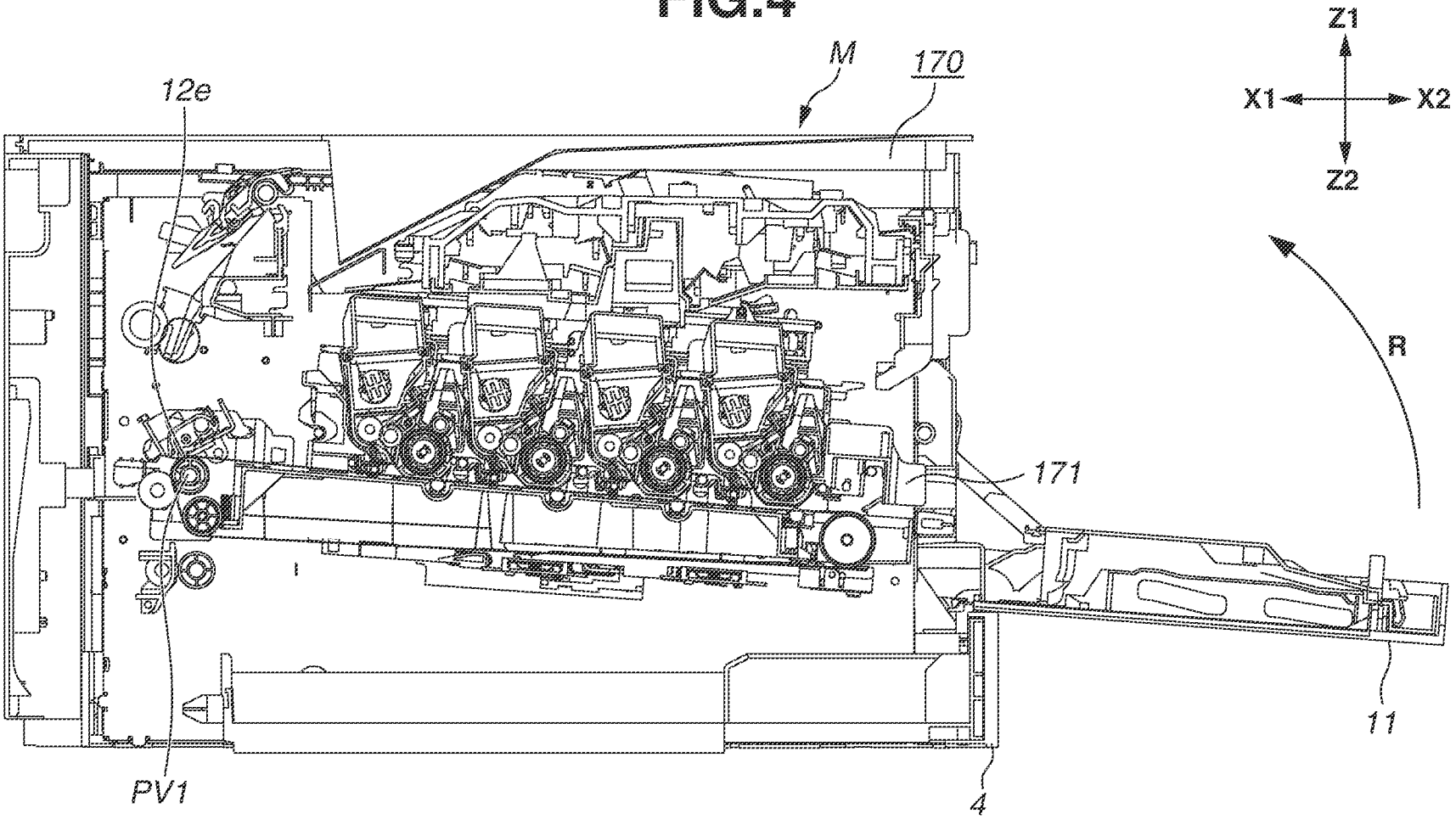
FIG. 4 is a sectional view illustrating the image forming apparatus according to the first exemplary embodiment.
Figure 5:
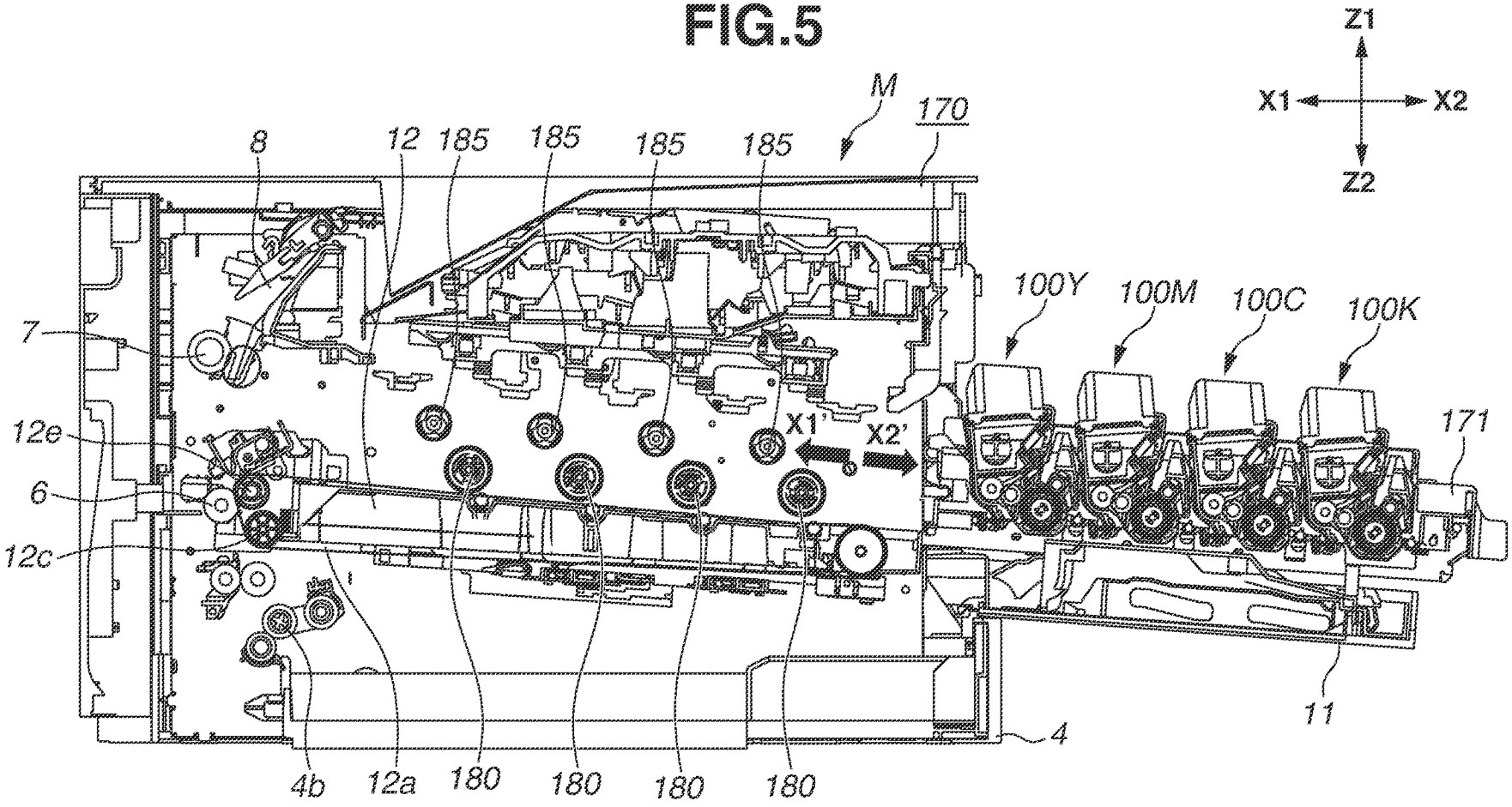
FIG. 5 a sectional view illustrating the image forming apparatus according to the first exemplary embodiment.
Figure 6:
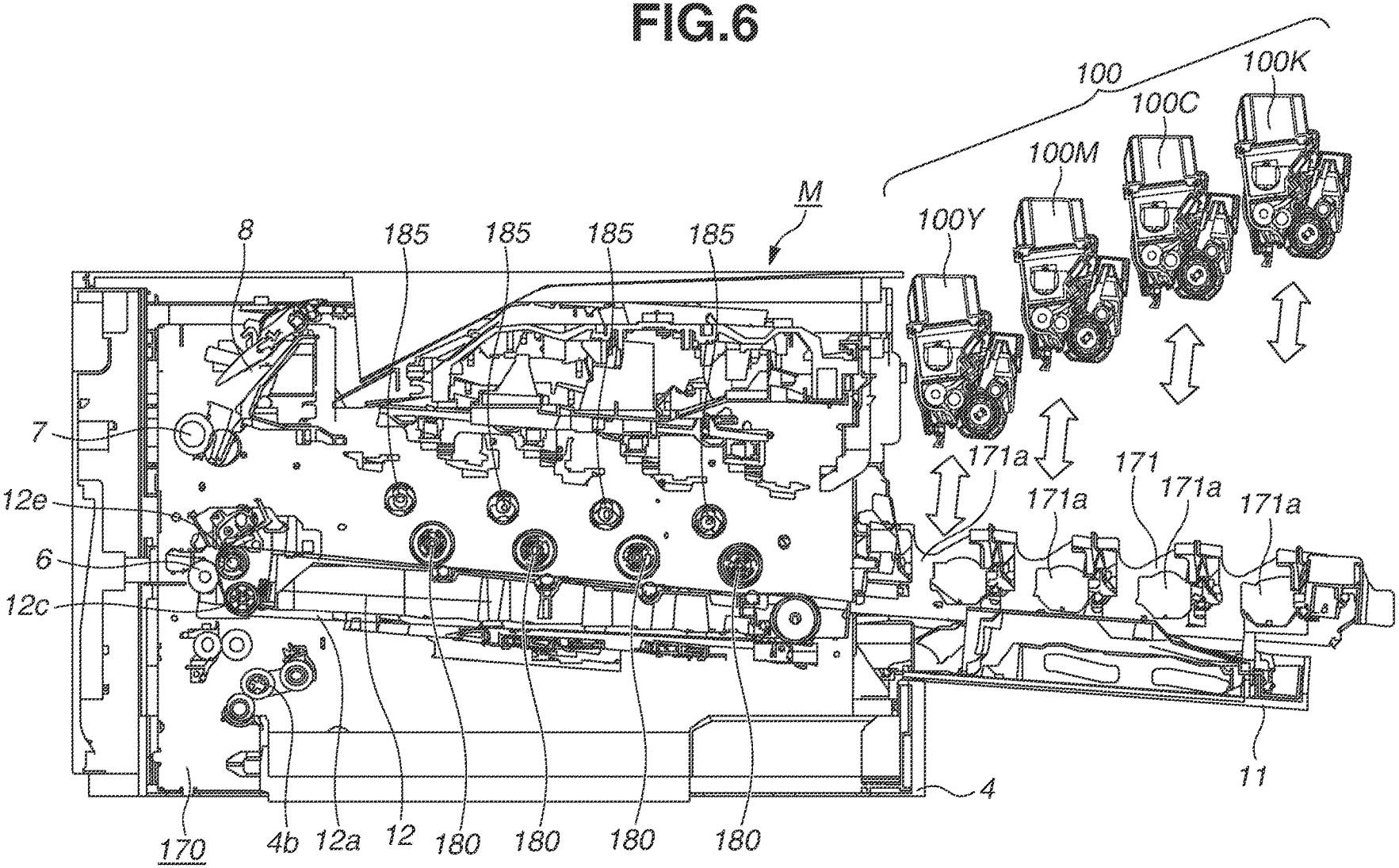
FIG. 6 a sectional view illustrating the image forming apparatus according to the first exemplary embodiment.
Figure 7A:
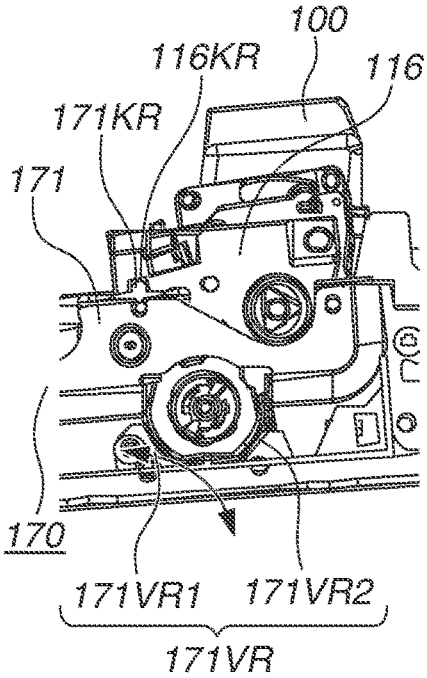
FIGS. 7A and 7B are partial detailed views each illustrating a tray according to the first exemplary embodiment.
Figure 7B:
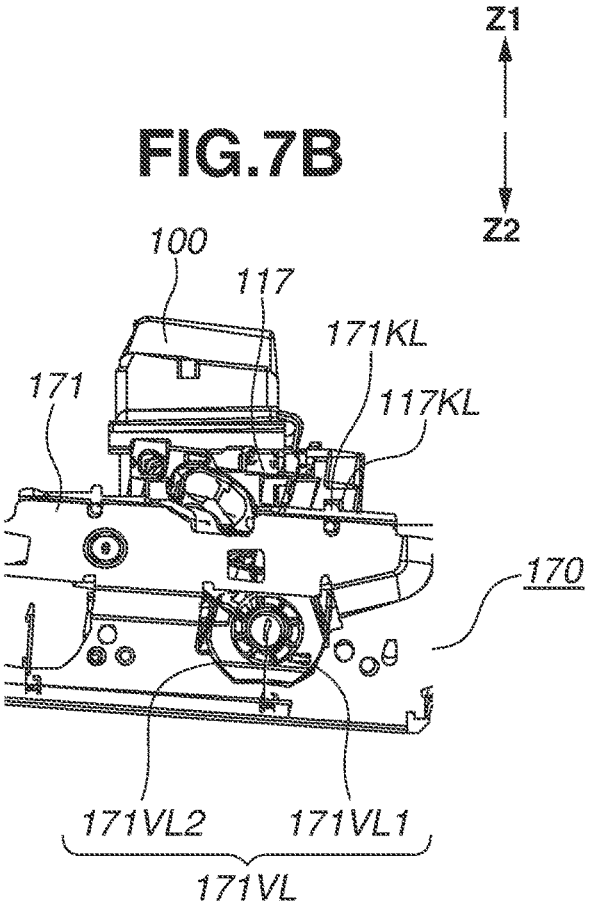

A cartridge support member (hereinafter, referred to as a tray) 171 for supporting the first to fourth cartridges 100 (100Y, 100M, 100C, and 100K) will be described in more detail with reference to FIGS. 4 to 7A and 7B. FIG. 4 is a sectional view of the image forming apparatus M in a state where the front door 11 is open and the tray 171 is inside the image forming apparatus main body 170. FIG. 5 is a sectional view of the image forming apparatus M in a state where the front door 11 is open, the tray 171 is outside the image forming apparatus main body 170, and the cartridges 100 are accommodated in the tray 171. FIG. 6 is a sectional view of the image forming apparatus M in a state where the front door 11 is open, the tray 171 is outside the image forming apparatus main body 170, and the cartridges 100 are detached from the tray 171. FIGS. 7A and 7B are partial detailed views of the tray 171. FIG. 7A is a partial detailed view of the tray 171 in the state of FIG. 4, seen from the driving side. FIG. 7B is a partial detailed view of the tray 171 in the state of FIG. 4, seen from the non-driving side.

As illustrated in FIGS. 4 and 5, the tray 171 can be moved in a direction of an arrow X1 (push-in direction) and a direction of an arrow X2 (pull-out direction) with respect to the image forming apparatus main body 170. In other words, the tray 171 is disposed to be capable of being pulled out of and pushed into the image forming apparatus main body 170. The tray 171 is configured to be substantially horizontally movable in a state where the image forming apparatus main body 170 is installed on a horizontal surface. A state where the tray 171 is outside the image forming apparatus main body 170 (the state of FIG. 5) will be referred to as an outside position. A state where the front door 11 is open, the tray 171 is inside the image forming apparatus main body 170, and the photosensitive drums 104 are separated from the transfer belt 12*a* (the state of FIG. 4) will be referred to as an inside position.

The tray 171 includes attachment portions 171*a* to which the cartridges 100 can be detachably attached as illustrated in FIG. 6 at the outside position. The cartridges 100 attached to the attachment portion 171*a* with the tray 171 at the outside position are supported on the tray 171 by respective driving side covers 116 and non-driving side covers 117 as illustrated in FIGS. 7A and 7B. The cartridges 100 attached to the attachment portions 171*a* move into the image forming apparatus main body 170 as the tray 171 moves. Here, the cartridges 100 move so that the photosensitive drums 104 are kept at a distance from the transfer belt 12*a*. The tray 171 can move the cartridges 100 into the image forming apparatus main body 170 without the photosensitive drums 104 touching the transfer belt 12*a*.

As described above, the tray 171 can move the plurality of cartridges 100 together to a position inside the image forming apparatus main body 170 where the cartridges 100 can form images. The tray 171 can move the plurality of cartridges 100 together out of the image forming apparatus main body 170.

[Positioning of Cartridges to Electrophotographic Image Forming Apparatus Main Body]

The positioning of the cartridges 100 to the image forming apparatus main body 170 will be described in more detail with reference to FIGS. 7A and 7B.

As illustrated in FIGS. 7A and 7B, the tray 171 includes positioning portions 171VR and 171VL for holding each of the cartridges 100. The positioning portion 171VR includes straight portions 171VR1 and 171VR2. Arc portions 116VR1 and 116VR2 (see FIG. 10) of the driving side cover 116 are in contact with the straight portions 171VR1 and 171VR2, whereby the center of the photosensitive drum 104 is determined.

The tray 171 illustrated in FIGS. 7A and 7B includes a rotation determining protrusion 171KR. The rotation determining protrusion 171KR is engaged with a rotation determining recess 116KR in the driving side cover 116 illustrated in FIG. 7A, whereby the orientation of the cartridge 100 with respect to the image forming apparatus main body 170 is determined.

The tray 171 also includes a positioning portion 171VL and a rotation determining protrusion 171KL. The positioning portion 171VL and the rotation determining protrusion 171KL are disposed at positions (on the non-driving side) opposite the positioning portion 171VR and the rotation determining protrusion 171KR, respectively, with the transfer belt 12*a* therebetween in the longitudinal direction of the cartridge 100. The positioning portion 171VL includes straight portions 171VL1 and 171VL2. Arc portions (not illustrated) of the non-driving side cover 117 are engaged with the positioning portion 171VL, and a rotation determining recess 117KL is engaged with the rotation determining protrusion 171KL, whereby the position of the cartridge 100 on the non-driving side is determined. The arc portions of the non-driving side cover 117 have a similar shape to that of the arc portions 116VR1 and 116VR2 of the driving side cover 116.

In such a manner, the cartridges 100 are precisely positioned to the tray 171.

As illustrated in FIG. 5, the cartridges 100 integrated with the tray 171 move in the direction of the arrow X1 and are inserted up to the position of FIG. 4.

When the front door 11 is closed in a direction of an arrow R (see FIG. 4), the cartridges 100 are pressed by a cartridge pressing mechanism to be described below and fixed to the image forming apparatus main body 170 along with the tray 171. The transfer belt 12*a* comes into contact with the photosensitive drums 104 in an interlocking manner with the operation of the cartridge pressing mechanism. The resulting state is where an image is formed (FIG. 2).

In the present exemplary embodiment, the positioning portions 171VR and 171VL also serve as reinforcements for maintaining rigidity during the pull-out operation of the tray 171, and are therefore made of metal plates. However, this is not restrictive.

[Cartridge Pressing Mechanism]

Next, details of the cartridge pressing mechanism will be described with reference to FIGS. 8A and 8B.

Figure 8A:
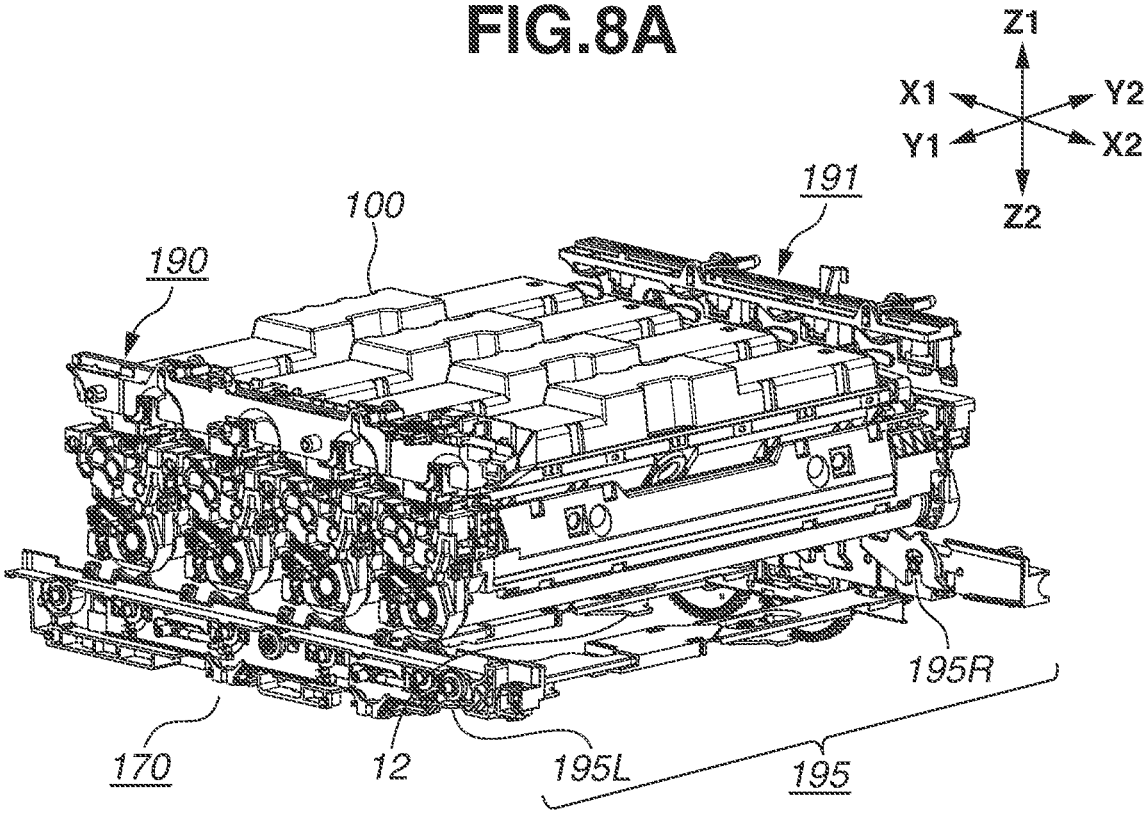
FIGS. 8A and 8B are perspective views each illustrating an interior of the image forming apparatus according to the first exemplary embodiment.
Figure 8B:
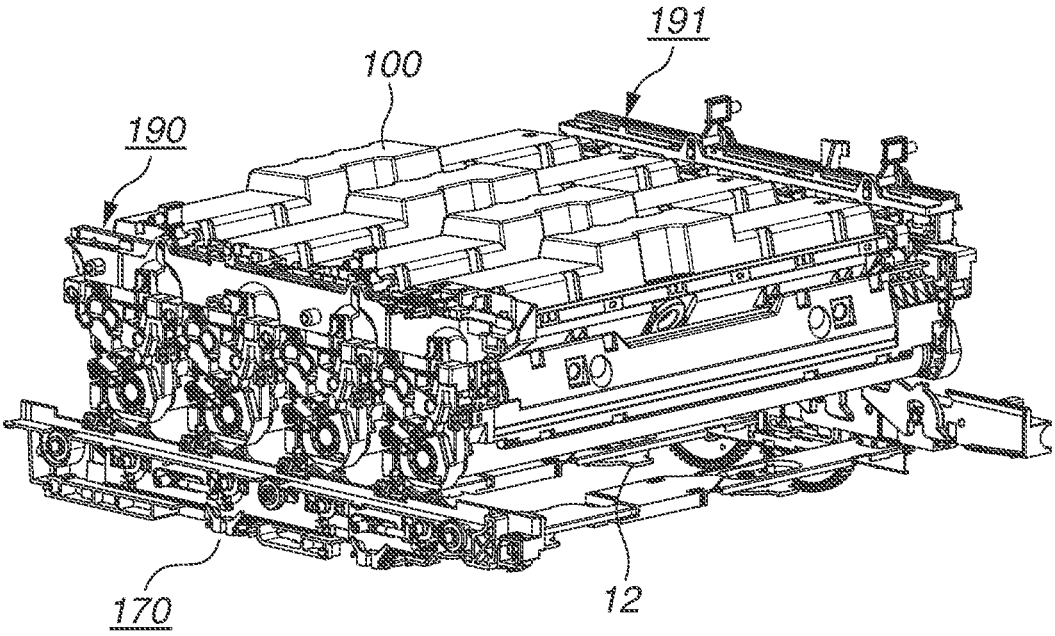

FIGS. 8A and 8B are perspective views for describing an interior of the image forming apparatus M. FIG. 8A is a perspective view for describing the interior of the image forming apparatus M in a state where the front door 11 is open. FIG. 8B is a perspective view for describing the interior of the image forming apparatus M in a state where the front door 11 is closed. FIG. 8A illustrates the cartridges 100, the tray 171, a cartridge pressing mechanism (190 and 191), the intermediate transfer unit 12, and developing separation control units 195 in the state of FIG. 4. FIG. 8B illustrates the cartridges 100, the tray 171, the cartridge pressing mechanism (190 and 191), the intermediate transfer unit 12, and the developing separation control units 195 in the state of FIG. 2.

During image formation, the cartridges 100 receive reaction force in a direction of an arrow Z1 from the primary transfer rollers 12*d* (FIG. 2) aside from driving force. The cartridges 100 are therefore desirably pressed in a direction of an arrow Z2 so that the cartridges 100 maintain a stable orientation during an image forming operation without being lifted from the positioning portions 171VR and 171VL.

To achieve this, in the present exemplary embodiment, the image forming apparatus main body 170 includes the cartridge pressing mechanism (190 and 191).

The cartridge pressing mechanism (190 and 191) includes a storage element pressing unit 190 in charge of the non-driving side and a cartridge pressing unit 191 in charge of the driving side. A more detailed description is given below.

When the front door 11 illustrated in FIG. 4 is closed, the storage element pressing unit 190 and the cartridge pressing unit 191 illustrated in FIGS. 8A and 8B move down in the direction of the arrow Z2.

The storage element pressing unit 190 includes main body side electrical contacts (not illustrated) that are in contact mainly with electrical contacts of storage elements (not illustrated) included in the cartridges 100. The storage element pressing unit 190 is interlocked with the front door 11 by a not-illustrated link mechanism so that the storage elements and the main body side electrical contacts can be brought into and out of contact.

In other words, the storage element pressing unit 190 is configured so that the contacts are brought into contact by closing the front door 11, and the contacts are separated by opening the front door 11.

Such a configuration prevents sliding of the electrical contacts when the cartridges 100 move inside the image forming apparatus main body 170 along with the tray 171. The configuration also prevents interference in insertion and withdrawal of the tray 171 by retracting the contacts from an insertion and withdrawal loci of the cartridges 100.

The storage element pressing unit 190 also has the function of pressing the cartridges 100 against the positioning portions 171VR described above.

Like the storage element pressing unit 190, the cartridge pressing unit 191 also moves down in the direction of the arrow Z2 in an interlocking manner with the closing operation of the front door 11. The cartridge pressing unit 191 has the function of pressing the cartridges 100 against the positioning portions 171VL described above.

The cartridge pressing mechanism (190 and 191) also has the function of pressing down force application members 152L and 152R of the cartridges 100 to be described below.

[Drive Transmission Mechanism]

Next, a drive transmission mechanism of the image forming apparatus main body 170 according to the present exemplary embodiment will be described with reference to FIGS. 9A, 9B, and 12.

Figure 9A:
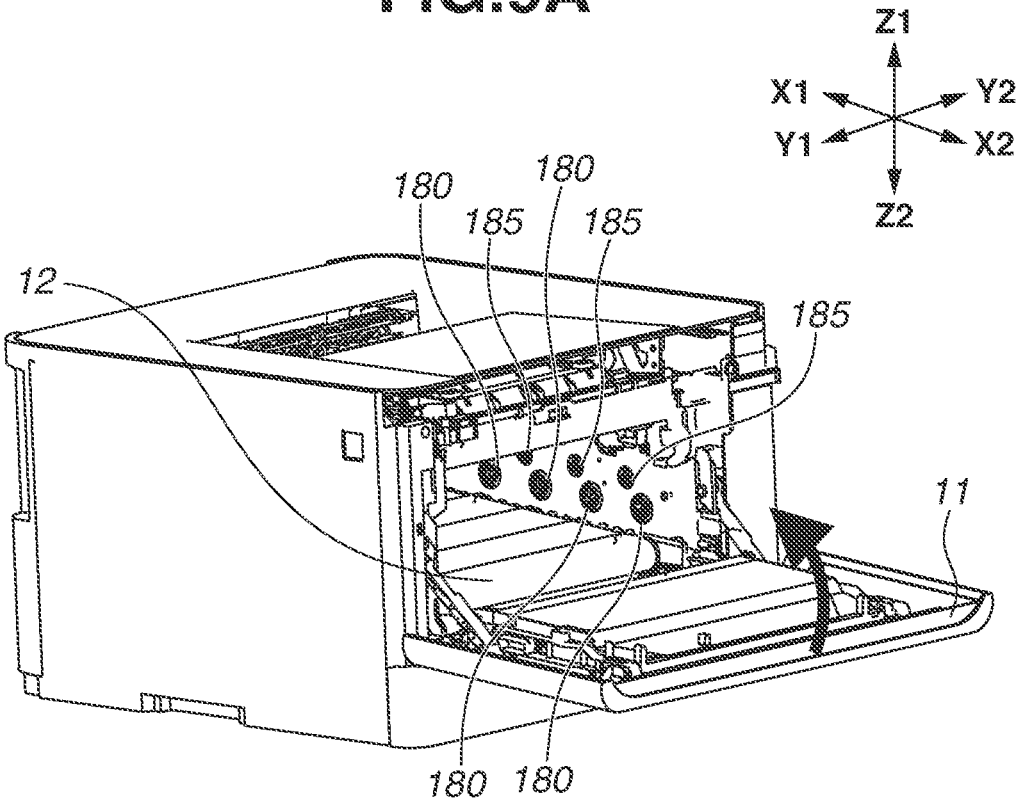
FIGS. 9A and 9B are perspective views each illustrating the image forming apparatus according to the first exemplary embodiment.
Figure 9B:
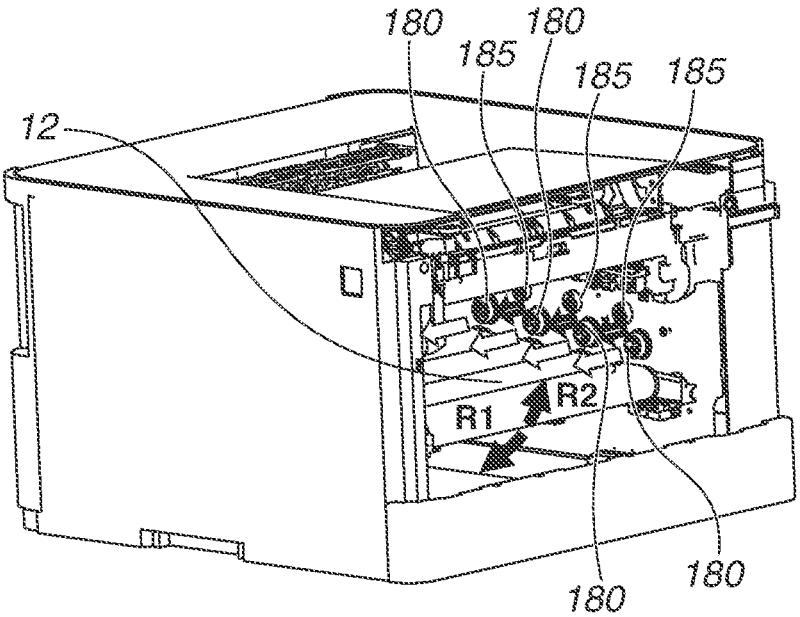

FIGS. 9A and 9B are perspective views of the image forming apparatus M. FIG. 9A is a perspective view of the image forming apparatus M in the state where the front door 11 is open. FIG. 9B is a perspective view of the image forming apparatus M in the state where the front door 11 is closed. FIG. 9A is a perspective view where the cartridges 100 and the tray 171 are omitted in the state of FIG. 4 or 5. FIG. 9B is a perspective view where the cartridges 100, the front door 11, and the tray 171 are omitted.

Figure 12:
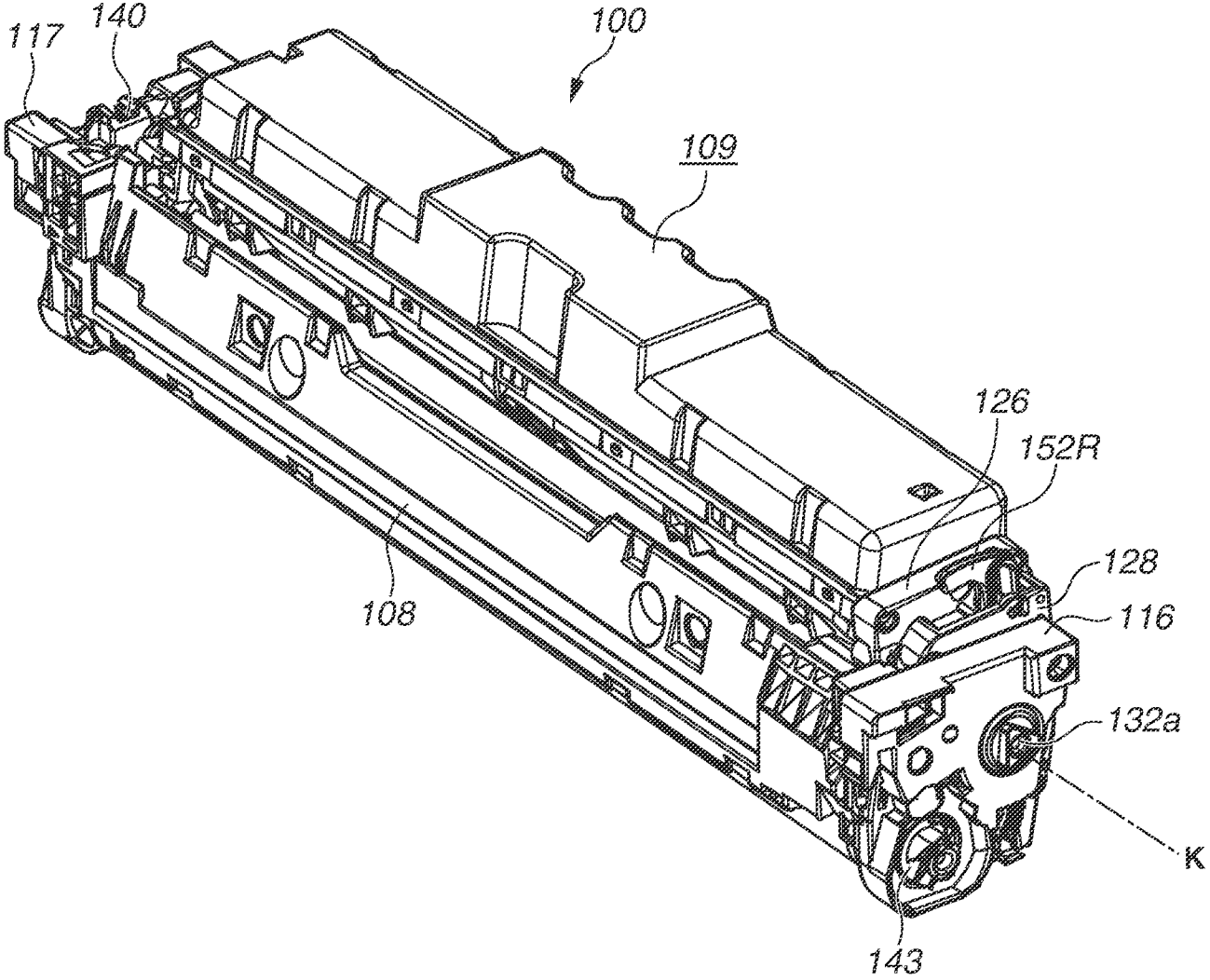
FIG. 12 is a perspective view illustrating the cartridge according to the first exemplary embodiment.

FIG. 12 is a perspective view of a cartridge 100 seen from the driving side.

As illustrated in FIG. 12, the cartridge 100 according to the present exemplary embodiment includes a developing coupling portion 132*a* and a drum coupling member (photosensitive member coupling member) 143.

When the front door 11 is closed (the state of FIG. 9B), main body side drum drive couplings 180 and main body side developing drive couplings 185 for transmitting drive to the cartridges 100 are protruded in a direction of an arrow Y1 by a not-illustrated link mechanism.

When the front door 11 is opened (the state of FIG. 9A), the main body side drum drive couplings 180 and the main body side developing drive couplings 185 are retracted in a direction of an arrow Y2.

The main body side drum drive couplings 180 and the main body side developing drive couplings 185 are retracted from the insertion and withdrawal loci of the cartridges 100 (the directions of the arrows X1 and X2) to not interfere in the insertion and withdrawal of the tray 171.

When the front door 11 is closed and the image forming apparatus main body 170 starts driving, the main body side drum drive couplings 180 are engaged with the drum coupling members 143. The main body side developing drive couplings 185 are also simultaneously engaged with the developing coupling portions 132*a*. As a result, drive is transmitted to the cartridges 100. The transmission of the drive to the cartridges 100 is not limited to such two-point transmission. Drive may be input to only the drum coupling members 143, and the cartridges 100 may include mechanisms for transmitting the drive to their developing rollers 106 inside.

[Configuration of Intermediate Transfer Unit]

Next, the intermediate transfer unit 12 of the image forming apparatus main body 170 according to the present exemplary embodiment will be described with reference to FIGS. 9A and 9B.

In the present exemplary embodiment, the intermediate transfer unit 12 is configured to be lifted in a direction of an arrow R2 up to the position for image formation (position where the photosensitive drums 104 are in contact with the transfer belt 12*a*) by a not-illustrated link mechanism when the front door 11 is closed.

When the front door 11 is opened, the intermediate transfer unit 12 moves down in a direction of an arrow R1, whereby the photosensitive drums 104 and the transfer belt 12*a* are separated.

In other words, with the cartridges 100 set in the tray 171, the photosensitive drums 104 and the transfer belt 12*a* are in contacted with and separated from each other based on the opening and closing operations of the front door 11.

In the contacting and separating operations, the intermediate transfer unit 12 is moved up and down to trace a rotation locus about a center point PV1 illustrated in FIG. 4.

The transfer belt 12*a* is driven by force from a gear (not illustrated) disposed coaxially with the center point PV1. Using the center point PV1 as the rotation center, the intermediate transfer unit 12 can thus be moved up and down without moving a center of the gear. This eliminates the need to move the gear center and can precisely maintain a position of the gear.

Such a configuration prevents sliding of the photosensitive drums 104 on the transfer belt 12*a* in inserting and withdrawing the tray 171 with the cartridges 100 set in the tray 171. Damage to the photosensitive drums 104 and image degradation due to charge memory can thus be avoided.

[Developing Separation Control Units]

Next, a separation mechanism of the image forming apparatus main body 170 according to the present exemplary embodiment will be described with reference to FIGS. 8A and 8B.

In the present exemplary embodiment, the developing separation control units 195 are engaged with part of the developing units 109 and thereby control separating and contacting operations of the developing units 109 with the photosensitive drums 104. As illustrated in FIG. 8A, the developing separation control units 195 are disposed in a lower part of the image forming apparatus main body 170. The developing separation control units 195 include a developing separation control unit 195R on the driving side and a developing separation control unit 195L on the non-driving side.

The developing separation control units 195 are disposed one each on both sides of the transfer belt 12*a* in the longitudinal direction of the photosensitive drums 104 (the directions of the arrows Y1 and Y2). More specifically, the developing separation control units 195 include the developing separation control unit 195R disposed in the driving side and the developing separation control unit 195L disposed in the non-driving side.

Disposing the developing separation control units 195 in a dead space of the image forming apparatus main body 170 as described above enables miniaturization of the image forming apparatus main body 170.

In order for the developing separation control units 195 to be engaged with part of the developing units 109 and control the separating and contacting operations of the developing units 109, part of the developing separation control units 195 and part of the developing units 109 desirably overlap in the vertical direction (the directions of the arrows Z1 and Z2).

Part of the developing units 109 (in the present exemplary embodiment, the force application members 152R and 152L) are therefore protruded after the developing units 109 of the cartridges 100 are inserted in the direction of the arrow X1.

[Overall Configuration of Cartridges]

A configuration of the cartridges 100 will be described with reference to FIGS. 3, 11, and 12.

Figure 11:
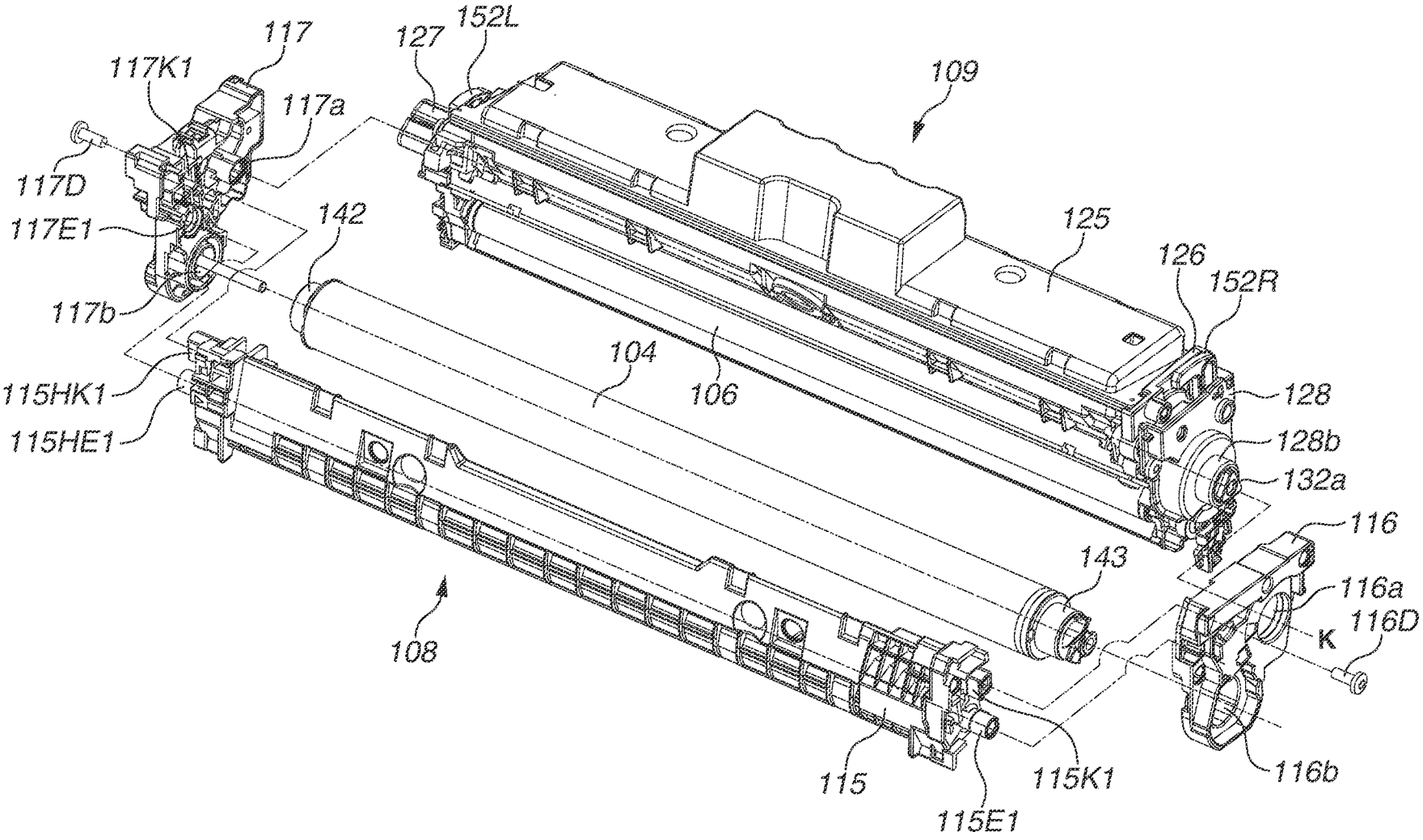
FIG. 11 is an exploded perspective view illustrating the cartridge according to the first exemplary embodiment.

FIG. 11 is an exploded perspective view of the cartridge 100 seen from the driving side that is one end side in the axial direction of the photosensitive drum 104. FIG. 12 is a perspective view of the cartridge 100 seen from the driving side. In the present exemplary embodiment, the first to fourth cartridges 100 (100Y, 100M, 100C, and 100K) have the same electrophotographic process mechanism and accommodate different amounts of toner of respective different colors.

Each of the cartridges 100 includes a photosensitive drum 104 and process units acting on the photosensitive drum 104. The cartridge 100 includes, as a process unit, a charging roller 105 that is a charging unit (charging member) for charging the photosensitive drum 104. The cartridge 100 also includes, as another process unit, a developing roller 106 that is a developing unit (developing member, developer bearing member) for developing a latent image formed on the photosensitive drum 104.

Examples of other process units may include a cleaning unit (for example, cleaning blade) for removing residual toner remaining on the surface of the photosensitive drum 104. However, the image forming apparatus M according to the present exemplary embodiment is configured to not include a cleaning unit that is in contact with the photosensitive drum 104.

The cartridge 100 is divided into the drum holding unit 108 and the developing unit 109.

[Configuration of Drum Holding Unit]

As illustrated in FIGS. 3 and 11, the drum holding unit 108 includes the photosensitive drum 104, the charging roller 105, and a drum frame 115 that is a first frame. The photosensitive drum 104 is integrated into a drum unit 103 (see FIG. 1A) along with the drum coupling member 143 and a drum flange 142. The drum unit 103 is rotatably supported by the driving side cover 116 and the non-driving side cover 117 disposed on respective longitudinal ends of the cartridge 100. The driving side cover 116 and the non-driving side cover 117 will be described below.

As illustrated in FIGS. 11 and 12, the drum coupling member 143 for transmitting driving force to the photosensitive drum 104 is disposed near one longitudinal end of the photosensitive drum 104. As described above, the drum coupling member 143 is engaged with the main body side drum drive coupling 180 (see FIGS. 9A and 9B) serving as a drum drive output unit of the image forming apparatus main body 170. The driving force of a drive motor (not illustrated) of the image forming apparatus main body 170 is transmitted to the photosensitive drum 104, whereby the photosensitive drum 104 is rotated in the direction of the arrow A in FIG. 3. The drum flange 142 is disposed near the other longitudinal end (second end) of the photosensitive drum 104.

The drum frame 115 supports the charging roller 105 so that the charging roller 105 is in contact with the photosensitive drum 104 to be driven to rotate by the photosensitive drum 104.

Of both longitudinal (axial) sides of the drum unit 103, one where the drum coupling member 143 is disposed is the driving side, and one where the drum flange 142 is disposed is the non-driving side. In other words, the drum coupling member 143 is fixed to near one of both ends of the photosensitive drum 104 on the driving side, and the drum flange 142 is fixed to near the end opposite the driving side.

Of both sides of cartridge 100, one where the drum coupling member 143 is disposed will be referred to as a driving side, and one opposite the driving side will be referred to as a non-driving side.

A unit including the drum frame 115, the driving side cover 116 and a screw 116D to be described below may be referred to as a frame unit. The frame unit may also include the non-driving side cover 117 and a screw 117D to be described below.

The drum holding unit 108 can be said to include the frame unit and the drum unit 103. The cartridge 100 can be said to include the frame unit. In the present exemplary embodiment, the cartridge 100 includes the drum unit 103, the charging roller 105, and the developing unit 109 in addition to the frame unit. In other words, the cartridge 100 can be said to include the drum holding unit 108.

[Configuration of Developing Unit]

As illustrated in FIGS. 3 and 11, the developing unit 109 includes the developing roller 106, a toner conveyance roller 107, a developing blade 130, and the developing frame 125. The developing frame 125 includes a lower frame 125*a* and a lid member 125*b*. The lower frame 125*a* and the lid member 125*b* are connected by, for example, ultrasonic welding. The developing frame 125 that is a second frame (second casing) includes a toner storage portion 129 for storing toner to be supplied to the developing roller 106. The developing frame 125 rotatably supports the developing roller 106 and the toner conveyance roller 107 via a driving side bearing 126 and a non-driving side bearing 127 to be described below, and holds the developing blade 130 for regulating toner thickness on the peripheral surface of the developing roller 106.

The developing blade 130 includes a support member 130*a* that is made of a metal material and has an L-shaped cross section, and an elastic member 130*b* that is a metal sheet having a thickness of 0.1 mm or so. The elastic member 130*b* is attached to the support member 130*a* by welding. The developing blade 130 is attached to the developing frame 125 with fixing screws 130*c* at two positions, namely, one and the other longitudinal end sides thereof. The developing roller 106 includes a core 106*c* made of a metal material, and a rubber portion 106*d*.

The developing roller 106 is rotatably supported by the driving side bearing 126 and the non-driving side bearing 127 attached to respective longitudinal ends of the developing frame 125. The developing frame 125, the driving side bearing 126, and the non-driving side bearing 127 are part of the frame (casing) of the cartridge 100. In a broad sense, the driving side bearing 126 and the non-driving side bearing 127 may be regarded as part of the developing frame 125. The driving side bearing 126, the non-driving side bearing 127, and the developing frame 125 can be referred to collectively as a developing frame.

As illustrated in FIGS. 11 and 12, the developing coupling portion 132*a* for transmitting driving force to the developing unit 109 is disposed on one longitudinal end side of the developing unit 109. The developing coupling portion 132*a* is engaged with the main body side developing drive coupling 185 (see FIGS. 9A and 9B) serving as a developing drive output unit of the image forming apparatus main body 170, whereby the driving force of a driving motor (not illustrated) of the image forming apparatus main body 170 is input to the developing unit 109. The driving force input to the developing unit 109 is transmitted by a not-illustrated drive train in the developing unit 109, whereby the developing roller 106 can be rotated in a direction of an arrow D in FIG. 3. A developing cover member 128 for supporting and covering the developing coupling portion 132*a* and the not-illustrated drive train is disposed on one longitudinal end side of the developing unit 109.

The developing roller 106 has an outer diameter smaller than that of the photosensitive drum 104. The photosensitive drum 104 has an outer diameter in the range of 18 to 22 mm. The developing roller 106 has an outer diameter in the range of 8 to 14 mm. Such settings of the outer diameters enable an efficient layout.

[Assembly of Drum Holding Unit and Developing Unit]

The assembly of the drum holding unit 108 and the developing unit 109 will be described with reference to FIG. 11.

The drum holding unit 108 and the developing unit 109 are connected by the driving side cover 116 and the non-driving side cover 117 disposed at respective longitudinal ends of the cartridge 100. The driving side cover 116 disposed on one longitudinal end side of the cartridge 100 has a developing unit support hole (first developing support portion) 116*a* for holding the developing unit 109. Similarly, the non-driving side cover 117 disposed on the other longitudinal end side of the cartridge 100 has a developing unit support hole (second developing support portion) 117*a* for supporting the developing unit 109. The developing unit 109 is swingably (rotatably) supported with respect to the drum holding unit 108 by the developing unit support holes 116*a* and 117*a*.

The driving side cover 116 and the non-driving side cover 117 also have drum support holes 116*b* and 117*b* for supporting the photosensitive drum 104. Specifically, the photosensitive drum 104 is rotatably supported by the driving side cover 116 and the non-driving side cover 117 via the drum coupling member 143 and the drum flange 142. The photosensitive drum 104, the driving side cover 116, and the non-driving side cover 117 can rotate integrally as the drum unit 103. In other words, the drum support hole 116*b* has a function as a first drum support portion for supporting the drum unit 103, and the drum support hole 117*b* has a function as a second drum support portion for supporting the drum unit 103.

On the one end side, an outer diameter portion of a cylindrical portion 128*b* of the developing cover member 128 is engaged with the developing unit support hole 116*a* of the driving side cover 116. On the other end side, an outer diameter portion of a cylindrical portion (not illustrated) of the non-driving side bearing 127 is engaged with the developing unit support hole 117*a* of the non-driving side cover 117.

Moreover, both longitudinal ends of the drum unit 103 are engaged with the drum support hole 116*b* of the driving side cover 116 and the drum support hole 117*b* of the non-driving side cover 117. More specifically, the drum coupling member 143 is engaged with the drum support hole 116*b* of the driving side cover 116, and the drum flange 142 is engaged with the drum support hole 117*b* of the non-driving side cover 117. The driving side cover 116 and the non-driving side cover 117 are fixed to the drum frame 115 of the drum holding unit 108. A method for fixing the driving side cover 116 and the non-driving side cover 117 to the drum frame 115 of the drum holding unit 108 will be described in detail below.

The developing unit 109 is supported by the driving side cover 116 and the non-driving side cover 117 to be capable of rotation (also referred to as rotational movement or swinging). The developing unit 109 is rotatable with respect to the drum holding unit 108. The developing roller 106 is movable with respect to the photosensitive drum 104. During image formation, the developing unit 109 is at a position where the developing roller 106 is in contact with the photosensitive drum 104. The developing unit 109, other than during image formation, is at a position where the developing roller 106 is separated from the photosensitive drum 104.

FIG. 12 illustrates a state where the drum holding unit 108 and the developing unit 109 are assembled by the foregoing step and integrated as the cartridge 100.

An axis connecting the center of the developing unit support hole 116*a* of the driving side cover 116 and the center of the developing unit support hole 117*a* of the non-driving side cover 117 will be referred to as a swing axis K. The cylindrical portion 128*b* of the developing cover member 128 on the one end side is coaxial with the developing coupling portion 132*a*. In other words, the developing unit 109 has a configuration for receiving driving force from the image forming apparatus main body 170 transmitted along the swing axis K. The developing unit 109 is rotatably supported about the swing axis K. In the present exemplary embodiment, the swing axis K is parallel to the direction of the rotation axis of the developing roller 106.

[Contacting and Separation Operations of Developing Unit]

The developing unit 109 is rotatably supported by the drum holding unit 108 of the cartridge 100, and the developing roller 106 of the developing unit 109 can be brought into contact with and separated from the photosensitive drum 104. The contacting and separating operations of the developing unit 109 will be described in detail with reference to FIG. 10.

Figure 10:
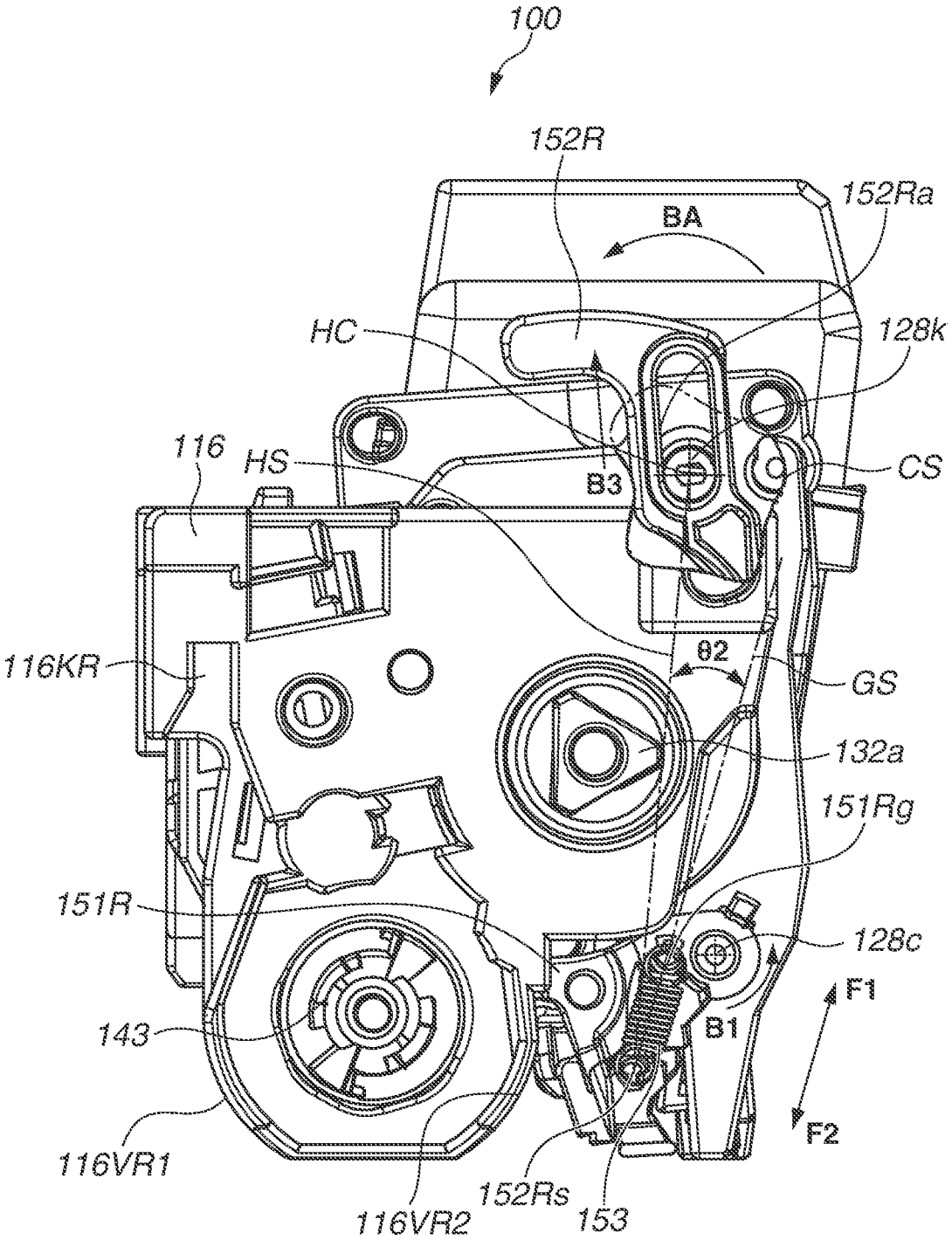
FIG. 10 is a side view (partially sectional view) illustrating the cartridge according to the first exemplary embodiment.

FIG. 10 is a side view (partially sectional view) of the cartridge 100. FIG. 10 is a sectional view where part of the driving side cover 116 and part of the developing cover member 128 are omitted along a partial section line CS.

As illustrated in FIG. 10, the force application member 152R, a separation holding member 151R, and a bias member (tension spring) 153 linked to the force application member 152R and the separation holding member 151R are disposed on the driving side of the cartridge 100.

The developing cover member 128 includes a first support portion 128*c* having a cylindrical shape and a second support portion 128*k* having a cylindrical shape protruding in the direction of the swing axis K. The separation holding member 151R is rotatably supported by the first support portion 128*c*. The force application member 152R includes a to-be-supported portion 152Ra to be supported by the second support portion 128*k*. The force application member 152R is supported to be movable in the longitudinal direction of the to-be-supported portion 152Ra and rotatable about the second support portion 128*k*. The tension spring 153 gives a biasing force to rotate the separation holding member 151R in a direction of an arrow B1 by applying force to a spring hook portion 151Rg of the separation holding member 151R in a direction of an arrow F2. The tension spring 153 also gives a biasing force to move the force application member 152R in a direction of an arrow B3 by applying force to a spring hook portion 152Rs of the force application member 152R in a direction of an arrow F1.

A line connecting the spring hook portion 151Rg of the separation holding member 151R and the spring hook portion 152Rs of the force application member 152R is a line GS. A line connecting the spring hook portion 152Rs of the force application member 152R and a swing axis HC of the separation holding member 151R is a line HS. An angle θ2 formed between the line GS and the line HS is set to 0° or more and not more than 90°. The force application member 152R is thereby biased to rotate about the swing axis HC in a direction of an arrow BA.

When the front door 11 is closed, the force application member 152R is pressed down from above by the cartridge pressing unit 191. As a result, the bottom end of the force application member 152R protrudes downward from the cartridge 100 and overlaps part of the developing separation control unit 195R. When the force application member 152R is moved by the developing separation control unit 195R, the separation holding member 151R moves between a separation position and a release position. When the separation holding member 151R is disposed at the separation position, the separation holding member 151R is in contact with the driving side cover 116 and the developing roller 106 is maintained away from the photosensitive drum 104. When the separation holding member 151R is retracted from the separation position and is at the release position, the developing roller 106 is allowed to enter a contact state where the developing roller 106 is in contact with the photosensitive drum 104.

The force application member 152L is disposed on the non-driving side of the cartridge 100 and supported by the non-driving side bearing 127 (see FIG. 11). A not-illustrated separation holding member corresponding to the separation holding member 151R is disposed on the non-driving side of the cartridge 100 and supported by the non-driving side bearing 127. A not-illustrated biasing member (tension spring) corresponding to the bias member 153 is disposed on the non-driving side of the cartridge 100. Since the configuration, arrangement, and functions of such members are similar to those on the driving side of the cartridge 100, a detailed description thereof will be omitted.

When the front door 11 is closed, the force application member 152L is pressed down from above by the storage element pressing unit 190. As a result, the bottom end of the force application member 152L protrudes downward from the cartridge 100 and overlaps part of the developing separation control unit 195L. When the force application member 152L is moved by the developing separation control unit 195L, the not-illustrated separation holding member moves between a separation position and a release position like the separation holding member 151R.

[Drum Unit]

Figure 1A:
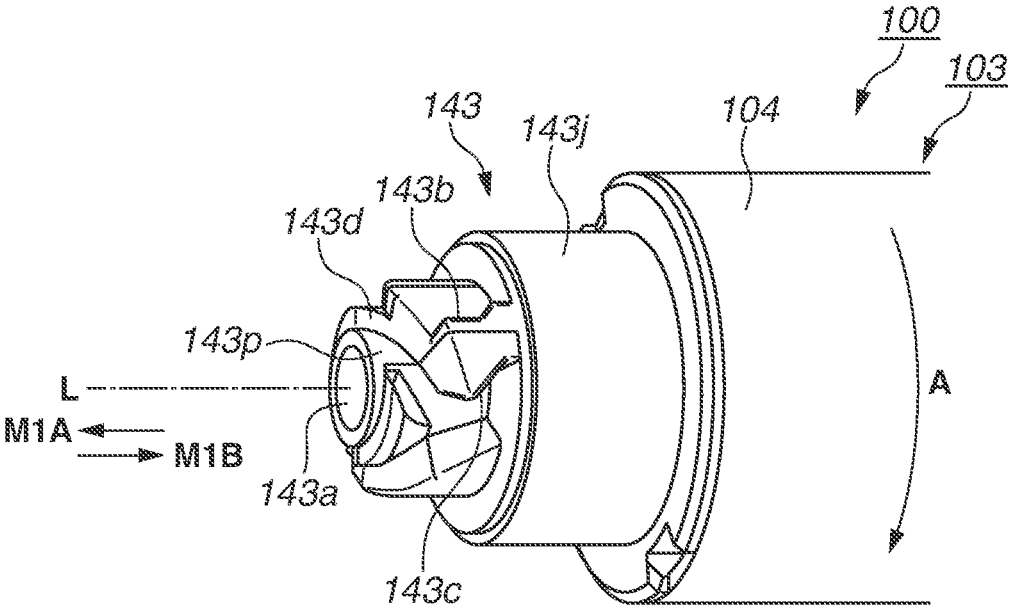
FIGS. 1A and 1B are perspective views each illustrating a drum unit according to a first exemplary embodiment.
Figure 1B:
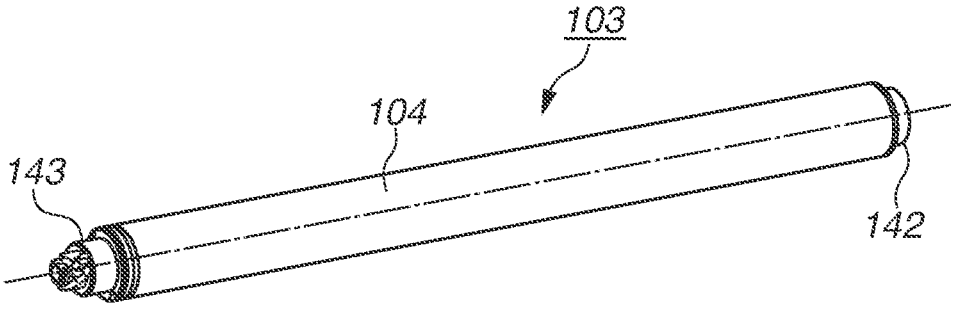

The drum unit 103 of the cartridge 100 will be described with reference to FIGS. 1A and 1B. FIGS. 1A and 1B are perspective views of the drum unit 103. FIG. 1A is a detailed view of the drum unit 103. FIG. 1B is an overall view of the drum unit 103.

The drum unit 103 illustrated in FIGS. 1A, 1B, and 11 includes the photosensitive drum (photosensitive unit, photosensitive member) 104, the drum coupling member (drum coupling) 143, and the drum flange 142. The drum unit 103 can be detachably attachable as a part of the cartridge 100 to the image forming apparatus main body 170. The drum unit 103 is configured so that, when attached to the image forming apparatus main body 170, the drum unit 103 can be coupled with a main body drive unit (not illustrated) disposed in the image forming apparatus main body 170. The drum unit 103 rotates in the direction of the arrow A during image formation. The drum coupling member 143 is disposed on the driving side of the drum unit 103, and the drum flange 142 is disposed on the non-driving side of the drum unit 103, in the direction of the rotation axis of the drum unit 103. When the drum unit 103 is seen from the driving side along the rotation axis of the drum unit 103, i.e., when the drum unit 103 is seen in a direction of an arrow M1B, a rotation direction A of the drum unit 103 is clockwise. The rotation axis of the drum unit 103 can also be referred to as the rotation axis of the photosensitive drum 104, the rotation axis of the drum coupling member 143, or the rotation axis of the drum flange 142.

The rotation direction A of the drum unit 103 will be described in terms of a movement of the surface of the photosensitive drum 104 (see FIG. 3). In FIG. 3, since the cartridge 100 is seen from the non-driving side, the rotation direction A of the drum unit 103 is counterclockwise. As illustrated in FIG. 3, the surface of the photosensitive drum 104 moves inside the cartridge 100 from a position near the charging roller 105 (position where the photosensitive drum 104 is in contact with the charging roller 105) to a position near the developing roller 106 (position where the photosensitive drum 104 is in contact with the developing roller 106). The surface of the photosensitive drum 104 then moves to a position under the cartridge 100 where the photosensitive drum 104 is exposed to outside, and returns to inside the cartridge 100 and moves to the position near the charging roller 105 again.

The drum coupling member 143 of the cartridge 100 will initially be described with reference to FIG. 1A.

The drum coupling member 143 according to the present exemplary embodiment is injection molded of a polyacetal resin. Resin materials, such as a polycarbonate resin and a polybutylene terephthalate resin, and these resin materials compounded with glass fibers or carbon fibers, may be used as the material. Alternatively, the drum coupling member 143 may be made of a metal material, such as aluminum, iron, and stainless steel, by using a machining method, such as die casting and cutting.

Next, the shape of the drum coupling member 143 will be described with reference to FIG. 1A. In the following description of the drum coupling member 143, a direction from the photosensitive drum 104 to a drive transmission unit (main body side drum drive coupling 180) along the axial direction (a direction of an arrow M1A) will be referred to as an outward direction in the axial direction. The direction opposite to the outward direction (the direction of the arrow M1B) will be referred to as an inward direction in the axial direction.

The drum coupling member 143 is attached to one longitudinal end (driving-side end) of the photosensitive drum 104. A shaft portion 143*j* illustrated in FIG. 1A is rotatably supported by the driving side cover 116 (see FIG. 11) supporting the drum unit 103. The drum unit 103 is configured to rotate in a predetermined rotation direction (the direction of the arrow A) during image formation when a latent image on the surface of the photosensitive drum 104 is developed.

The drum coupling member 143 is configured to receive driving force for rotating the photosensitive drum 104 from the main body drive unit of the image forming apparatus main body 170 and be able to receive braking force for imposing a load on the rotation of the photosensitive drum 104 as well.

The drum coupling member 143 includes a driving force receiving portion 143*b* serving as a first side surface portion for receiving the driving force from the main body drive unit. The drum coupling member 143 also includes a side surface portion 143*c*.

The driving force receiving portion 143*b* is a side surface portion facing upstream in the rotation direction A of the drum unit 103. The side surface portion 143*c* is one facing downstream in the rotation direction A.

In other words, either one of the driving force receiving portion 143*b* and the side surface portion 143*c* faces in a circumferential direction of the drum unit 103. The other faces in the other circumference direction. That is, the driving force receiving portion 143*b* and the side surface portion 143*c* are side surface portions facing mutually opposite in terms of the rotation direction or circumferential direction.

The drum coupling member 143 further includes a slope (inclined portion) 143*d* having a helical structure serving as a top surface portion. The slope (top surface portion) 143*d* is a portion facing axially outward (in the direction of the arrow M1A). In other words, the slope 143*d* is a portion facing in a direction away from the non-driving side end of the drum unit 103 (the end on the side where the drum flange 142 (see FIG. 11) is disposed). To put it another way, the top surface portion (slope 143*d*) of the drum coupling member 143 is a portion facing away from the side where the photosensitive drum 104 is disposed.

The slope 143*d* is inclined axially outward (in the direction of the arrow M1A) as it extends upstream in the rotation direction (upstream in the direction of the arrow A). That is, the slope 143*d* shifts away from the non-driving side of the drum unit 103 as it extends upstream in the rotation direction. In other words, the slope 143*d* inclines away from the photosensitive drum 104 as it extends upstream in the rotation direction.

The drum coupling member 143 further includes a circular hole portion 143*a* serving as an opening to be engaged with a positioning boss of the main body side drum drive coupling 180 of the image forming apparatus main body 170 for mutual axial alignment. The drum coupling member 143 includes a shaft portion 143*p* (see FIG. 1A) formed along an axis L (see FIG. 1A), and the circular hole portion 143*a* is formed in the shaft portion 143*p*. The shaft portion 143*p* and the circular hole portion 143*a* are on the axis L. The formation of the circular hole portion 143*a* provides an open space between the axis L (see FIG. 1A) of the drum unit 103 and the inner surface of the drum coupling member 143. The shaft portion 143*p* has a diameter smaller than that of the shaft portion 143*j* described above.

The drum coupling member 143 described above is symmetrical in shape about the axis L (see FIG. 1A). The drum coupling member 143 includes two driving force receiving portions 143*b*, two side surface portions 143*c*, and two slopes 143*d* having helical structures, and one each are circumferentially arranged to form a first coupling and a second coupling. In other words, the first coupling and the second coupling are symmetrically disposed about the axis L.

[Fixing of Driving Side Cover and Non-Driving Side Cover]

The fixing of the driving side cover 116 and the non-driving side cover 117 to the drum frame 115 will be described with reference to FIGS. 11, 13A, 13B, 13C, 14A, 14B, and 14C.

Figure 13C:
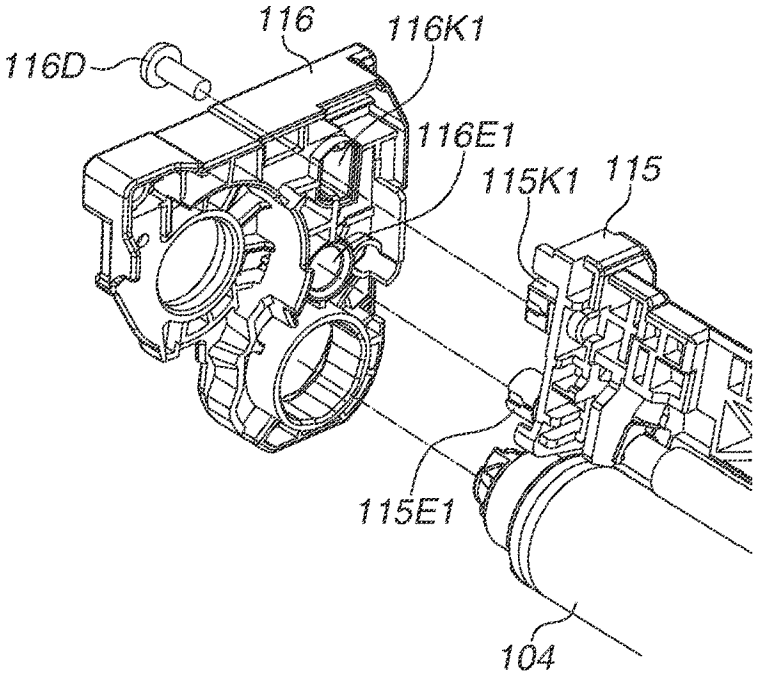
FIGS. 13A, 13B, and 13C are perspective views illustrating assembly of the cartridge according to the first exemplary embodiment.
Figure 13A:
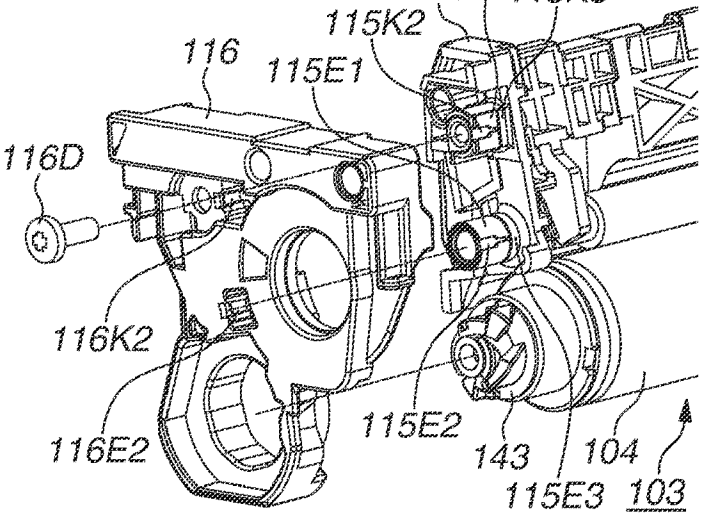
Figure 13B:
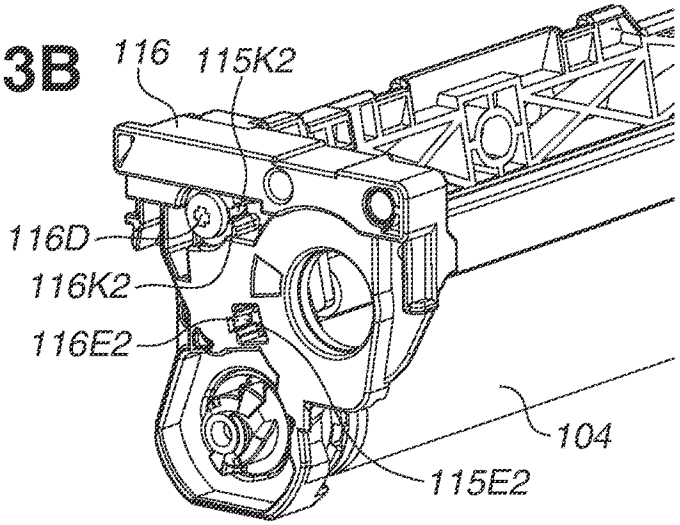

FIGS. 13A, 13B, and 13C are perspective views for describing the assembly of the cartridge 100 on the driving side. For the sake of description, the developing unit 109 is omitted in the diagrams.

FIGS. 13A and 13C are diagrams for describing the assembly of the driving side cover 116 to the drum frame 115. FIG. 13B is a diagram illustrating a state where the driving side cover 116 is fixed to the drum frame 115. FIGS. 13A and 13B are perspective views from the driving side. FIG. 13C is a perspective view from the non-driving side.

Figure 14C:
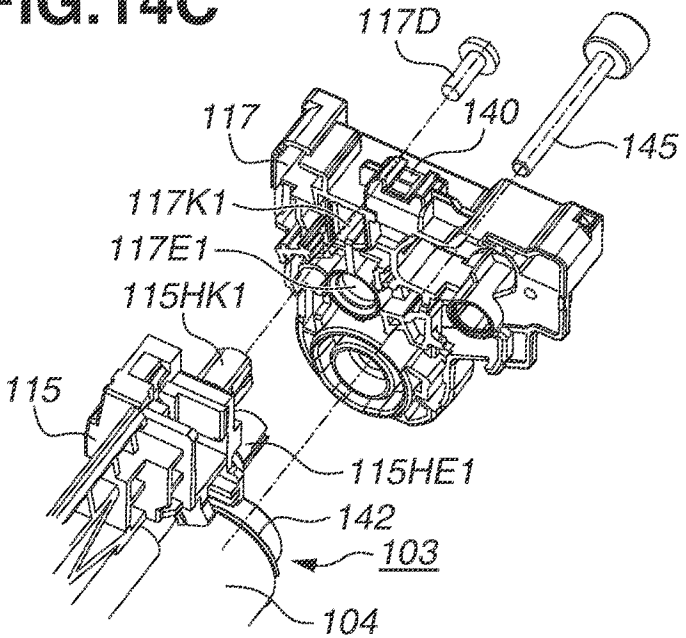
FIGS. 14A, 14B, and 14C are perspective views illustrating the assembly of the cartridge according to the first exemplary embodiment.
Figure 14A:
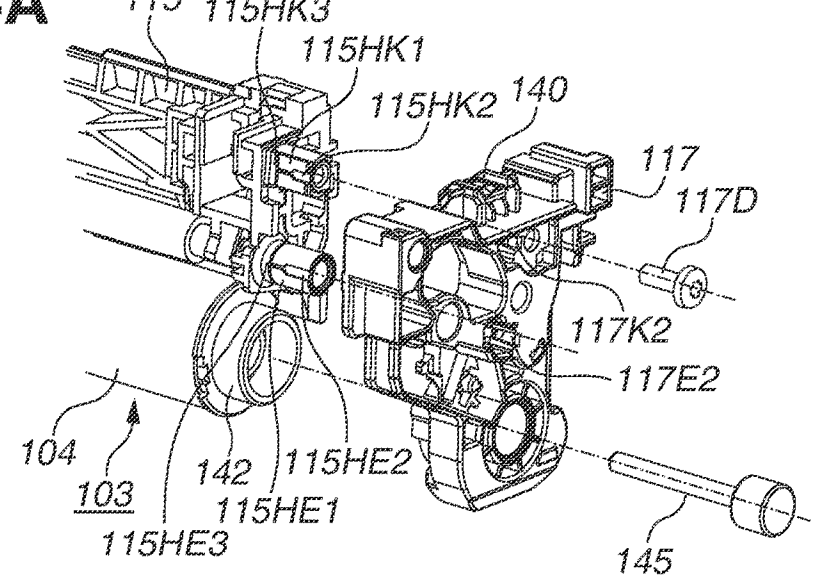
Figure 14B:
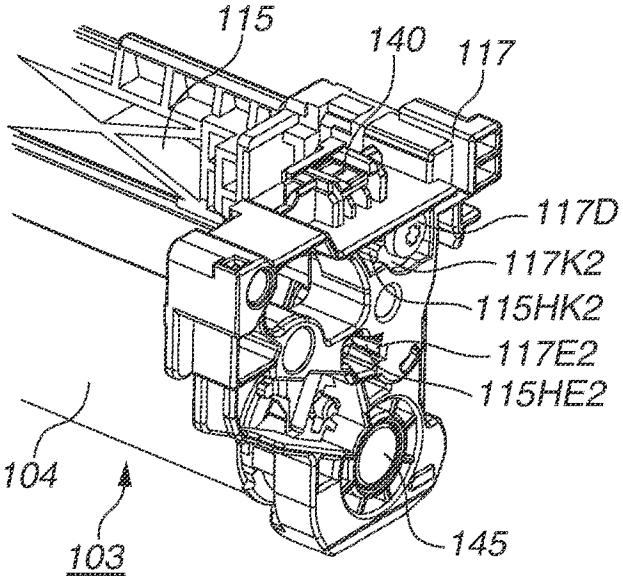

FIGS. 14A, 14B, and 14C are perspective views for describing the assembly of the cartridge 100 on the non-driving side. For the sake of description, the developing unit 109 is omitted in the diagrams.

FIGS. 14A and 14C are diagrams for describing the assembly of the non-driving side cover 117 to the drum frame 115. FIG. 14B is a diagram illustrating a state where the non-driving side cover 117 is fixed to the drum frame 115. FIGS. 14A and 14B are perspective views from the non-driving side. FIG. 14C is a perspective view from the driving side.

As illustrated in FIG. 11, the drum holding unit 108 and the developing unit 109 are connected by the driving side cover (first side member) 116 and the non-driving side cover (second side member) 117 disposed on respective longitudinal ends of the cartridge 100.

In the present exemplary embodiment, the longitudinal direction of the cartridge 100 is parallel to the direction of the rotation axis of the drum unit 103 and the direction of the rotation axis of the developing roller 106. The longitudinal direction of the drum holding unit 108 is parallel to the direction of the rotation axis of the drum unit 103. The longitudinal direction of the developing unit 109 is parallel to the direction of the rotation axis of the developing roller 106.

As described above, the developing unit 109 is engaged with the developing unit support hole 116*a* of the driving side cover 116 and the developing unit support hole 117*a* of the non-driving side cover 117. The drum unit 103 is engaged with the drum support hole 116*b* of the driving side cover 116 and the drum support hole 117*b* of the non-driving side cover 117. The driving side cover 116 and the non-driving side cover 117 are fixed to the drum frame 115 of the drum holding unit 108. The developing roller 106 can be moved between the position where the developing roller 106 is in contact with the photosensitive drum 104 and the position where the developing roller 106 is separated from the photosensitive drum 104 by the developing unit 109 swinging with respect to the drum holding unit 108.

The drum frame 115 includes a driving side end (first end) and a non-driving side end (second end) in the direction of the rotation axis of the drum unit 103 (first direction). The non-driving side end is disposed opposite the driving side end in the direction of the rotation axis of the drum unit 103. The driving side cover 116 is attached to the driving side end. The non-driving side cover 117 is attached to the non-driving side end.

The drum frame 115 includes a first positioning portion 115E1 and a first rotation determining portion (first rotation stopping portion) 115K1 to fix the position of the driving side cover 116. The first positioning portion 115E1 and the first rotation determining portion 115K1 are disposed on the driving side end of the drum frame 115.

The drum frame 115 includes a second positioning portion 115HE1 and a second rotation determining portion (second rotation stopping portion) 115HK1 to fix the position of the non-driving side cover 117. The second positioning portion 115HE1 and the second rotation determining portion 115HK1 are disposed on the non-driving side end of the drum frame 115.

The driving side cover 116 has a first positioning hole (first to-be-positioned portion) 116E1 to be engaged with the first positioning portion 115E1, and a first rotation determining hole (first rotation to-be-stopped portion) 116K1 to be engaged with the first rotation determining portion 115K1 (see FIGS. 11, 13A, and 13C).

The non-driving side cover 117 has a second positioning hole (second to-be-positioned portion) 117E1 to be engaged with the second positioning portion 115HE1, and a second rotation determining hole (second rotation to-be-stopped portion) 117K1 to be engaged with the second rotation determining portion 115HK1 (see FIGS. 11, 14A, and 14C).

The first positioning portion 115E1, the first rotation determining portion 115K1, the second positioning portion 115HE1, and the second rotation determining portion 115HK1 are protrusions (projections, bosses) extending in the direction of the rotation axis of the photosensitive drum 104 (the direction of the rotation axis of the drum unit 103).

When the first positioning portion 115E1 and the first positioning hole 116E1 are engaged, a surface of the first positioning portion 115E1 extending in the direction of the rotation axis of the drum unit 103 is in contact with the driving side cover 116 inside the first positioning hole 116E1. This restricts movement (translation) of the driving side cover 116 with respect to the drum frame 115 in directions intersecting the rotation axis of the drum unit 103. In the present exemplary embodiment, the movement (translation) of the driving side cover 116 with respect to the drum frame 115 in directions orthogonal to the direction of the rotation axis of the drum unit 103 is restricted.

When the first rotation determining portion 115K1 and the first rotation determining hole 116K1 are engaged, a surface of the first rotation determining portion 115K1 extending in the direction of the rotation axis of the drum unit 103 is in contact with the driving side cover 116 inside the first rotation determining hole 116K1. This restricts rotation of the driving side cover 116 with respect to the drum frame 115 about the first positioning portion 115E1.

When the second positioning portion 115HE1 and the second positioning hole 117E1 are engaged, a surface of the second positioning portion 115HE1 extending in the direction of the rotation axis of the drum unit 103 is in contact with the non-driving side cover 117 inside the second positioning hole 117E1. This restricts movement (translation) of the non-driving side cover 117 with respect to the drum frame 115 in directions intersecting the direction of the rotation axis of the drum unit 103. In the present exemplary embodiment, the movement (translation) of the non-driving side cover 117 with respect to the drum frame 115 in directions orthogonal to the direction of the rotation axis of the drum unit 103 is restricted.

When the second rotation determining portion 115HK1 and the second rotation determining hole 117K1 are engaged, a surface of the second rotation determining portion 115HK1 extending in the direction of the rotation axis of the drum unit 103 is in contact with the non-driving side cover 117 inside the second rotation determining hole 117K1. This restricts rotation of the non-driving side cover 117 with respect to the drum frame 115 about the second positioning portion 115HE1.

In the present exemplary embodiment, an adhesive is used to firmly fix the driving side cover 116 and the non-driving side cover 117 to the drum frame 115.

The first positioning portion 115E1 and the second positioning portion 115HE1 have substantially the same shape, and so do the first rotation determining portion 115K1 and the second rotation determining portion 115HK1. The first positioning hole 116E1 and the second positioning hole 117E1 have substantially the same shape, and so do the first rotation determining hole 116K1 and the second rotation determining hole 117K1. The configuration for fixing the driving side cover 116 to the drum frame 115 is thus similar to that for fixing the non-driving side cover 117 to the drum frame 115. The configuration for fixing the driving side cover 116 to the drum frame 115 will thus be described in detail, and the configuration for fixing the non-driving side cover 117 to the drum frame 115 will be described in a simplified form.

The first positioning portion 115E1 is a cylindrical boss and has a circular cross section in a direction orthogonal to the rotation axis of the drum unit 103. The first rotation determining portion 115K1 is a polygonal boss, and its cross section in a direction orthogonal to the rotation axis of the drum unit 103 includes straight-lined portions. In other words, the first positioning portion 115E1 includes an arcuate surface, and the first rotation determining portion 115K1 includes flat surfaces.

The first positioning hole 116E1 of the driving side cover 116 is a circular hole to be engaged with the first positioning portion 115E1. The first rotation determining hole 116K1 is a hole including flat surfaces. The flat surfaces are restricted by the first rotation determining portion 115K1. In other words, the first positioning hole 116E1 includes an arcuate surface, and the first rotation determining hole 116K1 includes flat surfaces.

The shapes of the first positioning portion 115E1, the first rotation determining portion 115K1, the first positioning hole 116E1, and the first rotation determining hole 116K1 are not limited to the foregoing. For example, the first rotation determining portion 115K1 may have a circular cross section. The first rotation determining hole 116K1 may be an oblong hole including flat surfaces for restricting a rotation of the first rotation determining portion 115K1.

At least either the first positioning hole 116E1 or the first positioning portion 115E1, or the first rotation determining hole 116K1 and the first rotation determining portion 115K1, are adhesively bonded. In other words, an adhesive is applied to at least either between the first positioning hole 116E1 or the first positioning portion 115E1 or between the first rotation determining hole 116K1 and the first rotation determining portion 115K1.

In the present exemplary embodiment, the first positioning hole 116E1 and the first positioning portion 115E1, and the first rotation determining hole 116K1 and the first rotation determining portion 115K1, are both fixed by adhesion. If either the first positioning hole 116E1 and the first positioning portion 115E1, or the first rotation determining hole 116K1 and the first rotation determining portion 115K1, is fixed, the other not-fixed pair allows movement of the driving side cover 116 in the longitudinal direction of the drum frame 115. According to the configuration of the present exemplary embodiment, the first positioning hole 116E1 and the first positioning portion 115E1 are adhesively bonded, and the first rotation determining hole 116K1 and the first rotation determining portion 115K1 are adhesively bonded. The driving side cover 116 can thus be precisely positioned to the drum frame 115 in the longitudinal direction of the drum frame 115.

The application of the adhesive to between portions making surface contacts, like between the first positioning hole 116E1 and the first positioning portion 115E1 and between the first rotation determining hole 116K1 and the first rotation determining portion 115K1, can firmly bond the portions. In particular, the application of the adhesive to between portions where flat surfaces make contact, like the first rotation determining hole 116K1 and the first rotation determining portion 115K1, can firmly bond the portions.

The first positioning hole 116E1 and the first rotation determining hole 116K1 have cutouts (exposing portions) 116E2 and 116K2 for flowing the adhesive over the first positioning portion 115E1 and the first rotation determining portion 115K1. The first positioning portion 115E1 and the first rotation determining portion 115K1 have flow grooves 115E2 and 115K2 for flowing the adhesive. The flow grooves 115E2 and 115K2 extend in the direction of the rotation axis of the drum unit 103.

In the present exemplary embodiment, the drum unit 103, the developing unit 109, the driving side cover 116, and the non-driving side cover 117 are combined to constitute the cartridge 100 before the adhesive is applied. The cutouts 116E2 and 116K2 expose the flow grooves 115E2 and 115K2 to outside the driving side cover 116. Applying the adhesive via the cutouts 116E2 and 116K2 after the members are combined and assembled into the cartridge 100 can prevent the adhesive from adhering to other parts.

The applied adhesive spreads out inside the gap between the first positioning hole 116E1 and the first positioning portion 115E1 and the gap between the first rotation determining hole 116K1 and the first rotation determining portion 115K1 by capillary action. To stably flow the adhesive by capillary action, the gap between the first positioning hole 116E1 and the first positioning portion 115E1 and the gap between the first rotation determining hole 116K1 and the first rotation determining portion 115K1 are desirably greater than 0 mm and less than or equal to 0.1 mm. In the present exemplary embodiment, the gap between the first positioning hole 116E1 and the first positioning portion 115E1 and the gap between the first rotation determining hole 116K1 and the first rotation determining portion 115K1 are approximately 50 μm.

The presence of the gap between the first positioning hole 116E1 and the first positioning portion 115E1 and the gap between the first rotation determining hole 116K1 and the first rotation determining portion 115K1 sometimes causes a positional deviation of the driving side cover 116 from the drum frame 115. This can affect the positional accuracy of the photosensitive drum 104 and the developing unit 109 with respect to the drum frame 115. The positional deviation of the driving side cover 116 from the drum frame 115 is desirably prevented as much as possible.

In the present exemplary embodiment, part of the first positioning portion 115E1 is therefore pressed into part of the first positioning hole 116E1, and part of the first rotation determining portion 115K1 is pressed into part of the first rotation determining hole 116K1.

Specifically, as illustrated in FIG. 13A, press-in portions 115E3 and 115K3 to be pressed into the first positioning hole 116E1 and the first rotation determining hole 116K1 are disposed at the bottom of the first positioning portion 115E1 and the first rotation determining portion 115K1, respectively. This can precisely determine the positions of the drum frame 115 and the driving side cover 116. The press-in portions 115E3 and 115K3 can also prevent leakage of the applied adhesive.

The adhesive is a solution not affecting the photosensitive drum 104 or other components. In the present exemplary embodiment, a terpene solution is used. Among terpene solutions, d-limonene is suitably used. The drum frame 115, the driving side cover 116, and the non-driving side cover 117 can be made of the same type of thermoplastic resin. The drum frame 115, the driving side cover 116, and the non-driving side cover 117 are made of a polystyrene (PS) resin. The material of the adhesive and the materials of the drum frame 115, the driving side cover 116, and the non-driving side cover 117 can be selected depending on the intended use as long as the adhesion surfaces can be adhesively bonded and hardened together.

It takes time for the applied adhesive to cure and fix the driving side cover 116 to the drum frame 115 and the non-driving side cover 117 to the drum frame 115. If external force is applied to the cartridge 100 before the adhesive cures, the driving side cover 116 and the non-driving side cover 117 can shift in position with respect to the drum frame 115 and the adhesive can cure in the shifted state.

The screws 116D and 117D having a function as a temporary fastener before curing of the adhesive are therefore used to hold the drum frame 115 and the driving side cover 116, and the drum frame 115 and the non-driving side cover 117 until the adhesive cures.

In the present exemplary embodiment, the driving side cover 116 is fixed to the drum frame 115 with the screw 116D. The non-driving side cover 117 is fixed to the drum frame 115 with the screw 117D. The adhesive is then applied. This can hold the driving side cover 116 and the non-driving side cover 117 in position with respect to the drum frame 115 until the adhesive cures.

The screw (first fixing member) 116D is disposed in such a state that the driving side cover 116 is held between the drum frame 115 and the screw 116D. The driving side cover 116 can thus be fixed to the drum frame 115 until the adhesive cures. After the curing of the adhesive, the driving side cover 116 is fixed to the drum frame 115 by adhesion. The driving side cover 116 remains fixed to the drum frame 115 even if the screw 116D is removed in the fixed state.

The screw 116D is fastened to the first positioning portion 115E1 or the first rotation determining portion 115K1 of the drum frame 115. This eliminates the need to provide an installation space for the screw 116D aside from the installation space for the first positioning portion 115E1 and the first rotation determining portion 115K1. In fixing the driving side cover 116 to the drum frame 115 by the adhesive, the positional deviation of the driving side cover 116 can thus be prevented by the screw 116D while installing the screw 116D with saved space. In other words, the drum frame 115 can be prevented from increasing in size.

In the present exemplary embodiment, the screw 116D is fastened to the first rotation determining portion 115K1 of the drum frame 115.

The screw 116D is a self-tapping screw. To prevent the first rotation determining portion 115K1 from being deformed by the fastening of the screw 116D, a fastening force of the screw 116D is desirably as small as possible. The reason is that deformation of the first rotation determining portion 115K1 lowers the positioning accuracy of the driving side cover 116 with respect to the drum frame 115. Another reason is that the adhesive can be unable to flow if the first rotation determining portion 115K1 is deformed and is in close contact with the first rotation determining hole 116K1.

Such a fastening force as the screw 116D is fastened enough to prevent the positional deviation of the driving side cover 116 until the adhesive cures is sufficient. In the present exemplary embodiment, the screw 116D is thus fixed by smaller force than other screws. For example, the non-driving side bearing 127, the developing cover member 128, the driving side bearing 126, and the developing blade 130 are fixed to the developing frame 125 with screws. The screw 116D is fixed by a small force compared to forces of such screws. The screw 116D can thus also be removed by small force compared to such screws.

While the thickness of the first rotation determining portion 115K1 can be increase to suppress deformation, reducing the fastening force of the screw 116D can suppress deformation without increasing the size of the first rotation determining portion 115K1. If the screw 116D is fastened to a polygonal boss, the deformation of the polygonal boss by the screw 116D can be suppressed by locating the screw on the center axis of the maximum circle that can be drawn inside the polygonal boss. This can prevent the deformation of the first rotation determining portion 115K1 and enables accurate positioning of the driving side cover 116 to the drum frame 115 while efficiently flowing the adhesive by capillary action.

In the present exemplary embodiment, the screw 116D is fastened to the first rotation determining portion 115K1. However, a screw equivalent to the screw 116D may be fastened to the first positioning portion 115E1. Both the screw 116D to be fastened to the first rotation determining portion 115K1 and the screw to be fastened to the first positioning portion 115E1 may be used.

In the present exemplary embodiment, both the first positioning portion 115E1 and the first rotation determining portion 115K1 of the drum frame 115 are adhesively bonded. However, at least either one of the first positioning portion 115E1 or the first rotation determining portion 115K1 may be fixed by adhesion.

The cost for fixing two members by using an adhesive is lower than that by screwing. In the present exemplary embodiment, the first positioning hole 116E1 and the first positioning portion 115E1 are adhesively bonded, and so are the first rotation determining hole 116K1 and the first rotation determining portion 115K1. The fewer the parts to be bonded, the smaller the amount of adhesive usage and the lower the cost. However, in some of the portions not adhesively bonded, the fastening force of the screw 116D is increased to firmly fix the driving side cover 116, and consequently the first rotation determining portion 115K1 can be deformed by the fastening of the screw 116D. From such a reason, the first positioning hole 116E1 and the first positioning portion 115E1 are adhesively bonded, the first rotation determining hole 116K1 and the first rotation determining portion 115K1 are adhesively bonded, and the screw 116D is fastened by small force. This can firmly fix the driving side cover 116 to the drum frame 115 with high positional accuracy.

Next, the adhesion of the non-driving side cover 117 and the drum frame 115 will be described with reference to FIGS. 11, 14A, 14B, and 14C.

As illustrated in FIGS. 11, 14A, 14B, and 14C, the non-driving side cover 117 has the second positioning hole 117E1 and the second rotation determining hole 117K1 to be engaged with the second positioning portion 115HE1 and the second rotation determining portion 115HK1 of the drum frame 115, respectively. Like the driving side, the second rotation determining hole 117K1 of the non-driving side cover 117 and the second rotation determining portion 115HK1 of the drum frame 115 are fixed by the screw 117D (fixing member, second fixing member) having a function as a temporary fastener before the adhesive cures.

At least either the second positioning hole 117E1 or the second positioning portion 115HE1, or the second rotation determining hole 117K1 and the second rotation determining portion 115HK1, are adhesively bonded. In other words, the adhesive is applied to at least either between the second positioning hole 117E1 or the second positioning portion 115HE1 or between the second rotation determining hole 117K1 and the second rotation determining portion 115HK1.

In the present exemplary embodiment, the second positioning hole 117E1 and the second positioning portion 115HE1 are adhesively bonded, and the second rotation determining hole 117K1 and the second rotation determining portion 115HK1 are adhesively bonded.

The second positioning hole 117E1 and the second rotation determining hole 117K1 have cutouts (exposing portions) 117E2 and 117K2 for flowing the adhesive over the second positioning portion 115HE1 and the second rotation determining portion 115HK1, respectively. The second positioning portion 115HE1 and the second rotation determining portion 115HK1 have flow grooves 115HE2 and 115HK2 for flowing the adhesive. The flow grooves 115HE2 and 115HK2 extend in the direction of the rotation axis of the drum unit 103.

In the present exemplary embodiment, part of the second positioning portion 115HE1 is pressed into part of the second positioning hole 117E1, and part of the second rotation determining portion 115HK1 is pressed into part of the second rotation determining hole 117K1. Specifically, press-in portions 115HE3 and 115HK3 to be pressed into the second positioning hole 117E1 and the second rotation determining hole 117K1 are disposed at the bottom of the second positioning portion 115HE1 and the second rotation determining portion 115HK1, respectively.

The screw 117D is further used to hold and the non-driving side cover 117 on the drum frame 115 until the adhesive cures. The screw 117D is disposed in such a manner that the non-driving side cover 117 is held between the drum frame 115 and the screw 117D.

Like the driving side, the screw 117D is fastened to the second positioning portion 115HE1 or the second rotation determining portion 115HK1 of the drum frame 115.

In the present exemplary embodiment, the screw 117D is fastened to the second rotation determining portion 115HK1. However, a screw equivalent to the screw 117D may be fastened to the second positioning portion 115HE1. Both the screw 117D to be fastened to the second rotation determining portion 115HK1 and the screw to be fastened to the second positioning portion 115HE1 may be used.

In the present exemplary embodiment, both the second positioning portion 115HE1 and the second rotation determining portion 115HK1 of the drum frame 115 are adhesively bonded. However, at least either one of the second positioning portion 115HE1 or the second rotation determining portion 115HK1 may be fixed by adhesion.

The configuration and function of the cutouts 117E2 and 117K2 are similar to those of the cutouts 116E2 and 116K2 on the driving side. The configuration and function of the flow grooves 115HE2 and 115HK2 are similar to those of the flow grooves 115E2 and 115K2 on the driving side. The configuration and function of the press-in portions 115HE3 and 115HK3 are similar to those of the press-in portions 115E3 and 115K3 on the driving side. The configuration and function of the screw 117D and the condition about the fastening force of the screw 117D are similar to those of the screw 116D on the driving side. A detailed description thereof will thus be omitted.

<Method for Disassembling Cartridge>

To make a used cartridge 100 usable again, the developing unit 109, the drum unit 103, and the charging roller 105 can be detached to clean the cartridge 100, replace parts, and replenish the cartridge 100 with toner.

A method for disassembling the cartridge 100 and detaching process units, such as the developing unit 109, the drum unit 103, and the charging roller 105, from the cartridge 100 will now be described.

Since the drum frame 115, the driving side cover 116, and the non-driving side cover 117 are fastened by the adhesive, the driving side cover 116 and the non-driving side cover 117 are unable to be separated from the drum frame 115 by simply detaching the screws 116D and 117D. The cartridge 100 is thus disassembled with the driving side cover 116 and the non-driving side cover 117 still adhesively bonded to the drum frame 115.

More specifically, the cartridge 100 is disassembled with at least either the first positioning hole 116E1 or the first positioning portion 115E1, or the first rotation determining hole 116K1 and the first rotation determining portion 115K1, adhesively bonded. Also, the cartridge 100 is disassembled with at least either the second positioning hole 117E1 or the second positioning portion 115HE1, or the second rotation determining hole 117K1 and the second rotation determining portion 115HK1, adhesively bonded.

In the present exemplary embodiment, the cartridge 100 is disassembled both with the first positioning hole 116E1 and the first positioning portion 115E1 adhesively bonded and with the first rotation determining hole 116K1 and the first rotation determining portion 115K1 adhesively bonded. Also, the cartridge 100 is disassembled both with the second positioning hole 117E1 and the second positioning portion 115HE1 adhesively bonded and with the second rotation determining hole 117K1 and the second rotation determining portion 115HK1 adhesively bonded.

The method for disassembling the cartridge 100 according to the present exemplary embodiment includes a deformation step of deforming the drum frame 115 with the driving side cover 116 and the non-driving side cover 117 adhesively bonded to the drum frame 115. A step (detachment step, separation step) of detaching at least either one of the developing unit 109 or the drum unit 103 is performed by deforming the drum frame 115.

A projection area of the drum frame 115 projected on a plane orthogonal to the rotational axis of the drum unit 103 is smaller than those of the driving side cover 116 and the non-driving side cover 117 projected on the same plane. The drum holding unit 108 is thus configured so that the drum frame 115 can be easily deformed in a direction intersecting the rotation axis of the drum unit 103.

[Method for Detaching (Separating) Developing Unit]

Figure 15:
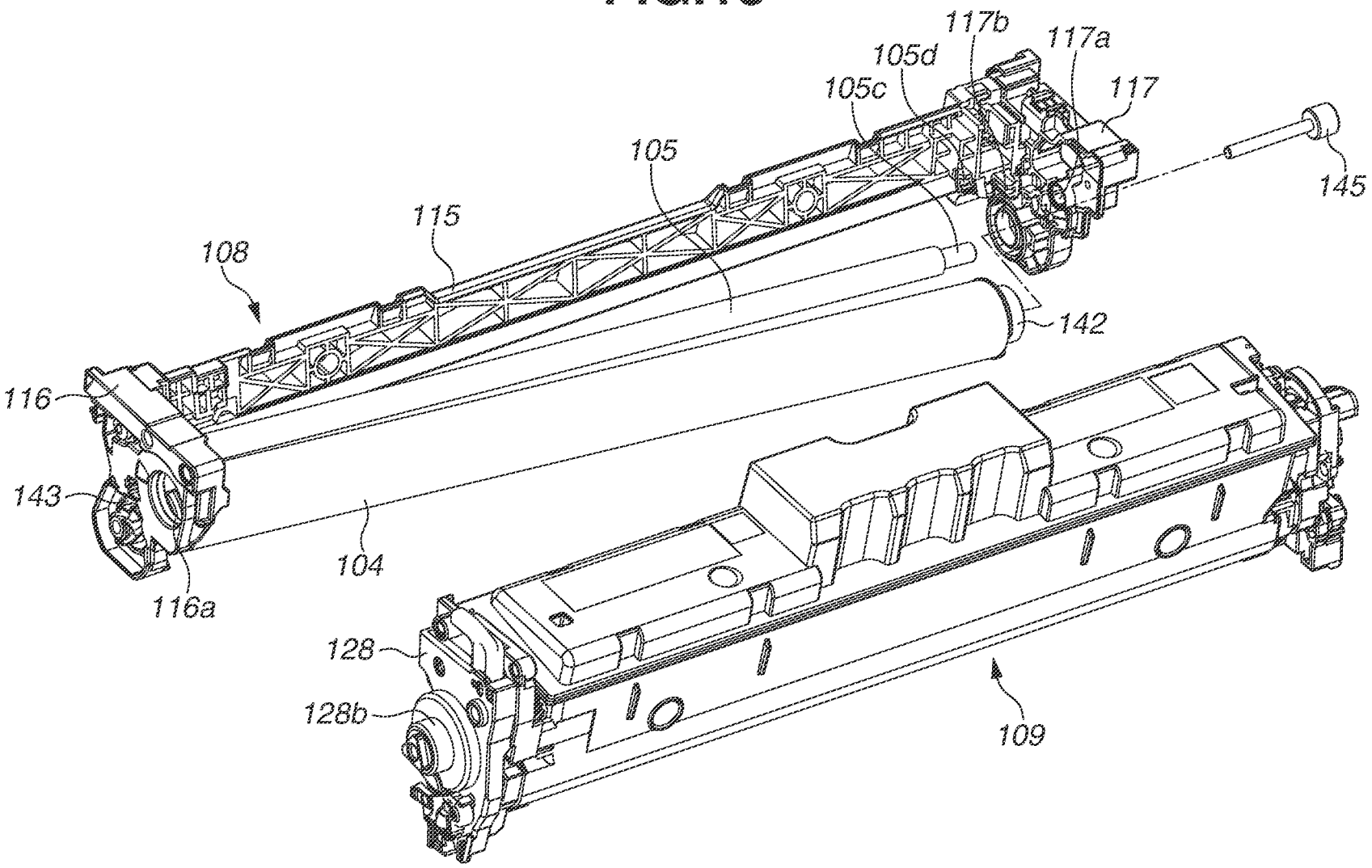
FIG. 15 is a diagram for describing disassembly illustrating the cartridge according to the first exemplary embodiment.

FIG. 15 is a diagram for describing the disassembly of the cartridge 100 according to the present exemplary embodiment. FIG. 15 is a perspective separation diagram of the cartridge 100, illustrating separation of the developing unit 109, the drum unit 103, and the charging roller 105.

A method for detaching the developing unit 109 from the cartridge 100 will initially be described.

As illustrated in FIGS. 11 and 15, the cylindrical portion 128*b* of the developing cover member 128 is engaged with the developing unit support hole 116*a* of the driving side cover 116, and the cylindrical portion (not illustrated) of the non-driving side bearing 127 is engaged with the developing unit support hole 117*a* of the non-driving side cover 117. The developing unit 109 can thus be detached from the cartridge 100 by disengaging these portions.

In the present exemplary embodiment, the portions can be disengaged by deforming the drum frame 115 with the driving side cover 116 and the non-driving side cover 117 adhesively bonded to the drum frame 115. In such a case, the drum frame 115 can be deformed in the middle in a direction intersecting the rotation axis of the drum unit 103.

By deforming the drum frame 115, the driving side cover 116 can be disengaged from the developing cover member 128, and the non-driving side cover 117 can be disengaged from the non-driving side bearing 127. Both or either one of the engagement between the driving side cover 116 and the developing cover member 128 and the engagement between the non-driving side cover 117 and the non-driving side bearing 127 may be disengaged with the drum frame 115 deformed.

[Method for Separating Drum Unit and Charging Roller]

Next, a method for separating the drum unit 103 and the charging roller 105 will be described.

As illustrated in FIG. 3, the drum unit 103 and the charging roller 105 are attached to the drum holding unit 108 including the drum frame 115. The photosensitive drum 104 and a center shaft 105*c* of the charging roller 105 are made of metal.

A ground pin 145 that is a metal pin is inserted into the non-driving side cover 117. More specifically, the ground pin 145 is fixed to the non-driving side cover 117 by press-in. The ground pin 145 is inserted into the drum flange 142.

As illustrated in FIG. 15, the ground pin (insertion shaft) 145 inserted into the drum flange 142 and the non-driving side cover 117 is initially removed.

The drum frame 115, the driving side cover 116, and the non-driving side cover 117 are adhesively bonded. After the removal of the ground pin 145, the drum unit 103 can be detach by bending (deforming) the drum frame 115. More specifically, the drum frame 115 is bent to move the drum support hole 116*b* (see FIG. 11) and the drum support hole 117*b* longitudinally outward, whereby the drum unit 103 can be detached.

In the present exemplary embodiment, the length of engagement (overlapping length) between the drum unit 103 and the drum support hole 117*b* in the direction of the rotation axis of the drum unit 103 is smaller than that between the drum unit 103 and the drum support hole 116*b*. The drum unit 103 is therefore desirably separated from the drum support hole 117*b* before the drum unit 103 is separated from the drum support hole 116*b*.

The charging roller 105 is rotatably engaged with charging roller bearings 105*d*. After the drum unit 103 is detached, the charging roller 105 can be separated by detaching the center shaft 105*c* of the charging roller 105 from the charging roller bearings 105*d* of the drum frame 115. The drum frame 115 does not need to be deformed in detaching the charging roller 105.

After the separation of the developing unit 109 from the cartridge 100, the developing unit 109 can be made usable again by replacing or cleaning parts and replenishing the developing unit 109 with toner as appropriate.

After the separation of the drum unit 103, the drum unit 103 can be made usable again by cleaning or replacing the photosensitive drum 104 as appropriate. The charging roller 105 can also be cleaned and made usable again as appropriate.

The cartridge 100 can be made usable again by attaching the developing unit 109, the drum unit 103, and the charging roller 105 to the frame unit including the drum frame 115, the driving side cover 116, and the non-driving side cover 117. In other words, the cartridge 100 can thereby be manufactured.

Here, the developing unit 109, the drum unit 103, and the charging roller 105 detached from the cartridge 100 can be used as the developing unit 109, the drum unit 103, and the charging roller 105. A developing unit 109, a drum unit 103, and a charging roller 105 detached from a different cartridge 100 may be used. A new developing unit 109, a new drum unit 103, and a new charging roller 105 may be used. The parts to be used can be selected as appropriate.

<Modification>

Another method for disassembling the cartridge 100 and detaching the process units, such as the developing unit 109, the drum unit 103, and the charging roller 105, from the cartridge 100 will be described as a modification.

The method for disassembling the cartridge 100 according to the present modification includes a cutting step of cutting apart the drum holding unit 108, and a step (detachment step, separation step) of detaching at least either one of the developing unit 109 or the drum unit 103.

Figure 16:
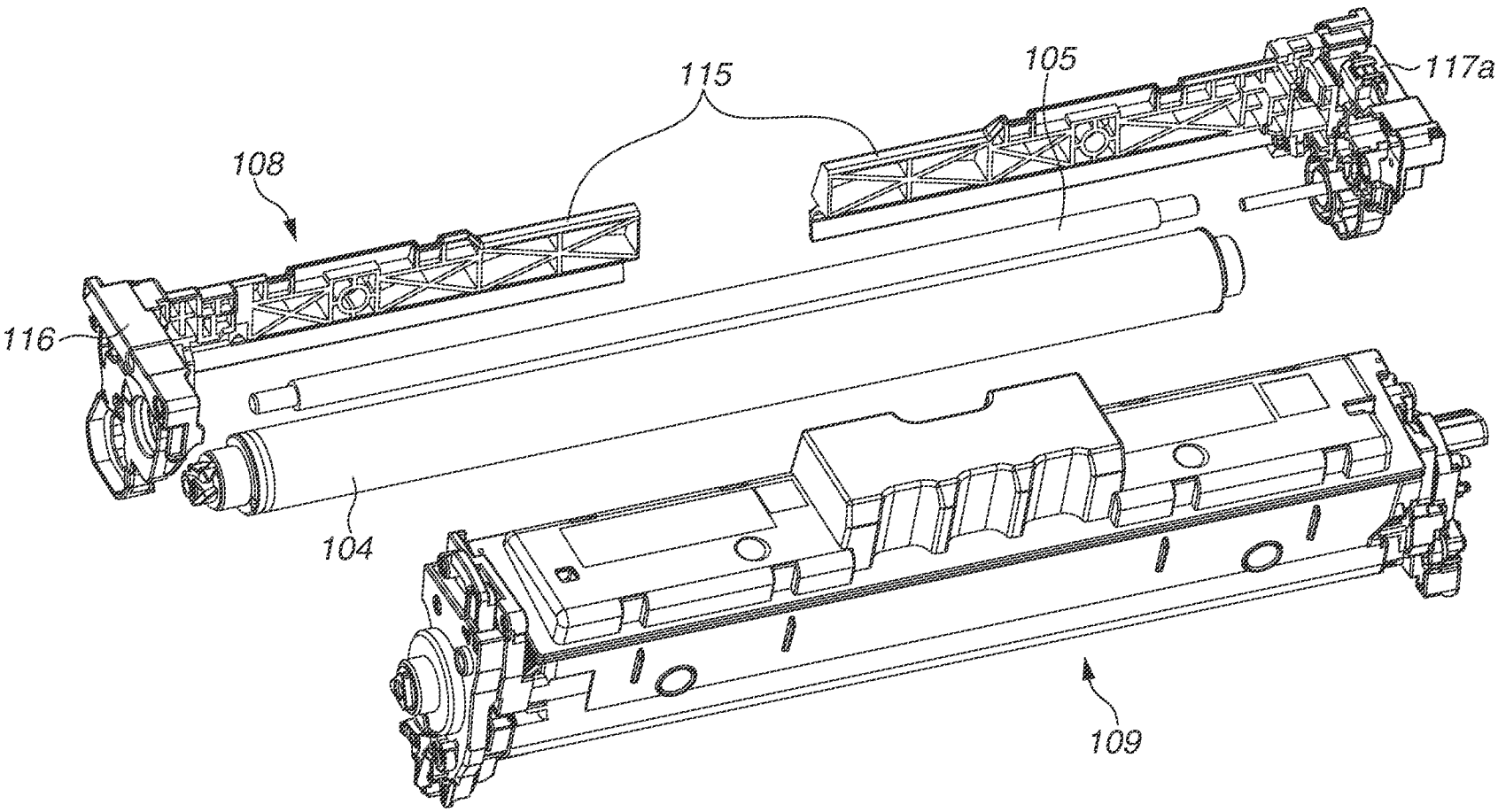
FIG. 16 is a diagram for describing disassembly illustrating the cartridge according to a modification of the first exemplary embodiment.

FIG. 16 is a diagram for describing disassembly of the cartridge 100 according to the modification. FIG. 16 illustrates the steps of cutting apart the drum holding unit 108 and separating the process units.

As illustrated in FIG. 16, the drum frame 115 can be cut apart in the longitudinal direction (the direction of the rotation axis of the drum unit 103) with the driving side cover 116 and the non-driving side cover 117 adhesively bonded to the drum frame 115. In the present modification, the drum frame 115 is cut apart in the middle. With the drum frame 115 cut apart, the driving side cover 116 and the non-driving side cover 117 can be moved away from each other with the driving side cover 116 and the non-driving side cover 117 still adhesively bonded to the drum frame 115. In other words, the driving side cover 116 and the non-driving side cover 117 can be separated from each other in the longitudinal direction. As a result, the process units, such as the developing unit 109, the drum unit 103, and the charging roller 105, can be detached from the support portions supporting the respective components.

After the process units are separated by the method of cutting the drum frame 115 apart, the process units may be replaced with new ones or cleaned for reuse. The cut pieces of the drum frame 115 can be adhesively bonded again. The process units may be attached to a new drum frame and used again as a cartridge.

After the separation of the developing unit 109 from the cartridge 100, the developing unit 109 can be made usable again by replacing or cleaning parts and replenishing the developing unit 109 with toner as appropriate.

After the separation of the drum unit 103, the drum unit 103 can be made usable again by cleaning or replacing the photosensitive drum 104 as appropriate. The charging roller 105 can also be cleaned and made usable again as appropriate.

The cartridge 100 can be made usable again by attaching the developing unit 109, the drum unit 103, and the charging roller 105 to the frame unit including the drum frame 115, the driving side cover 116, and the non-driving side cover 117. In other words, the cartridge 100 can thereby be manufactured.

Here, the developing unit 109, the drum unit 103, and the charging roller 105 detached from the cartridge 100 can be used as the developing unit 109, the drum unit 103, and the charging roller 105. A developing unit 109, a drum unit 103, and a charging roller 105 detached from a different cartridge 100 may be used. A new developing unit 109, a new drum unit 103, and a new charging roller 105 may be used. The parts to be used can be selected as appropriate.

The present modification has dealt with the method for cutting the drum frame 115 apart. However, the developing unit 109, the drum unit 103, and the charging roller 105 can be detached by cutting apart the driving side cover 116 or the non-driving side cover 117.

For example, the developing unit 109 may be detached by cutting the driving side cover 116 apart near the developing unit support hole 116*a* and cutting the non-driving side cover 117 apart near the developing unit support hole 117*a*. The drum unit 103 may be detached by cutting the driving side cover 116 apart near the drum support hole 116*b* and cutting the non-driving side cover 117 apart near the drum support hole 117*b*. With the drum unit 103 detached, the charging roller 105 can also be detached from the drum frame 115.

To prevent damage to the developing unit 109, the drum unit 103, and the charging roller 105, the drum frame 115 is desirably cut apart. The projection area of the drum frame 115 projected on a plane orthogonal to the rotational axis of the drum unit 103 is smaller than those of the driving side cover 116 and the non-driving side cover 117 projected on the same plane. Cutting the drum frame 115 apart can thus reduce the cutting length.

The drum frame 115, the driving side cover 116, and the non-driving side cover 117 which have been cut apart can be restored and used again in assembling the cartridge 100. The cartridge 100 may be assembled by using a new drum frame 115, a new driving side cover 116, and a new non-driving side cover 117.

The driving side cover 116 and the non-driving side cover 117 may be separated from the drum frame 115 by using a solution for removing the adhesive. In such a case, the developing unit 109, the drum unit 103, and the discharging roller 105 can be detached after the driving side cover 116 and the non-driving side cover 117 are separated from the drum frame 115.

The developing unit 109, the drum unit 103, and the charging roller 105 can be detached only when desirable. That is, the drum unit 103 and the charging roller 105 can be detached without detaching the developing unit 109. Similarly, the developing unit 109 can be detached without detaching the drum unit 103 or the charging roller 105.

As described above, according to an exemplary embodiment of the present exemplary embodiment, a cartridge including a frame and members fixed to the frame by adhesion can be prevented from increasing in size while preventing a positional deviation between the frame and members attached to the frame. Moreover, according to an exemplary embodiment of the present disclosure, a method for disassembling such a cartridge can be provided.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-155424, filed Sep. 16, 2020, which is hereby incorporated by reference herein in its entirety.

What is claimed is:

1. A cartridge comprising:

a frame including a first end in a first direction, a first positioning portion disposed on the first end, and a first rotation stopping portion disposed on the first end;

a first side member attached to the first end, wherein the first side member includes a first to-be-positioned portion configured to be engaged with the first positioning portion and a first rotation to-be-stopped portion configured to be engaged with the first rotation stopping portion, and wherein movement of the first side member in a direction intersecting the first direction is restricted by engagement of the first to-be-positioned portion with the first positioning portion, and rotation of the first side member about the first positioning portion is restricted by engagement of the first rotation to-be-stopped portion with the first rotation stopping portion; and a first fixing member fastened to the first positioning portion or the first rotation stopping portion, wherein the first fixing member is disposed to hold the first side member between the frame and the first fixing member, wherein at least either one of (i) the first to-be-positioned portion and the first positioning portion and (ii) the first rotation to-be-stopped portion and the first rotation stopping portion are adhesively bonded.

2. The cartridge according to claim 1, wherein the first to-be-positioned portion and the first positioning portion are adhesively bonded.

3. The cartridge according to claim 2, wherein part of the first positioning portion is pressed into part of the first to-be-positioned portion.

4. The cartridge according to claim 1, wherein the first rotation to-be-stopped portion and the first rotation stopping portion are adhesively bonded.

5. The cartridge according to claim 4, wherein part of the first rotation stopping portion is pressed into part of the first rotation to-be-stopped portion.

6. The cartridge according to any one of claim 1, wherein the frame includes a second end disposed opposite the first end in the first direction, a second positioning portion disposed on the second end, and a second rotation stopping portion disposed on the second end, the cartridge further comprising:

a second side member attached to the second end, wherein the second side member includes a second to-be-positioned portion configured to be engaged with the second positioning portion and a second rotation to-be-stopped portion configured to be engaged with the second rotation stopping portion, and wherein movement of the second side member in the direction intersecting the first direction is restricted by engagement of the second to-be-positioned portion with the second positioning portion, and rotation of the second side member about the second positioning portion is restricted by engagement of the second rotation to-be-stopped portion with the second rotation stopping portion; and a second fixing member fastened to the second positioning portion or the second rotation stopping portion, wherein the second fixing member is disposed to hold the second side member between the frame and the second fixing member, and wherein at least either one of (i) the second to-be-positioned portion and the second positioning portion and (ii) the second rotation to-be-stooped portion and the second rotation stopping portion are adhesively bonded.

7. The cartridge according to claim 6, wherein the second to-be-positioned portion and the second positioning portion are adhesively bonded.

8. The cartridge according to claim 7, wherein part of the second positioning portion is pressed into part of the second to-be-positioned portion.

9. The cartridge according to claim 6, wherein the second rotation to-be-stopped portion and the second rotation stopping portion are adhesively bonded.

10. The cartridge according to claim 9, wherein part of the second rotation stopping portion is pressed into part of the second rotation to-be-stopped portion.

11. The cartridge according to claim 6, further comprising:

a drum unit including a photosensitive unit; and a charging member configured to charge the photosensitive unit, wherein the first side member includes a first drum support portion configured to support the drum unit, and wherein the second side member includes a second drum support portion configured to support the drum unit.

12. The cartridge according to claim 11, further comprising a developing unit including a developing roller configured to develop an electrostatic latent image formed on the photosensitive unit, wherein the first side member includes a first developing support portion configured to support the developing unit, and wherein the second side member includes a second developing support portion configured to support the developing unit.

13. A method for disassembling a cartridge, wherein the cartridge includes:

a drum unit including a photosensitive unit, a charging member configured to charge the photosensitive unit, a developing unit including a developing roller configured to develop an electrostatic latent image formed on the photosensitive unit, and a frame unit including a frame, a first side member, a second side member, a first fixing member, and a second fixing member, wherein the frame includes a first end, a second end disposed opposite the first end in a first direction, a first positioning portion disposed on the first end, a first rotation stopping portion disposed on the first end, a second positioning portion disposed on the second end, and a second rotation stopping portion disposed on the second end, wherein the first side member is attached to the first end and includes a first to-be-positioned portion configured to be engaged with the first positioning portion, a first rotation to-be-stopped portion configured to be engaged with the first rotation stopping portion, a first drum support portion configured to support the drum unit, and a first developing support portion configured to support the developing unit, wherein movement of the first side member in a direction intersecting the first direction is restricted by engagement of the first to-be-positioned portion with the first positioning portion, and rotation of the first side member about the first positioning portion is restricted by engagement of the first rotation to-be-stopped portion with the first rotation stopping portion, wherein the second side member is attached to the second end and includes a second to-be-positioned portion configured to be engaged with the second positioning portion, a second rotation to-be-stopped portion configured to be engaged with the second rotation stopping portion, a second drum support portion configured to support the drum unit, and a second developing support portion configured to support the developing unit, wherein movement of the second side member in the direction intersecting the first direction is restricted by engagement of the second to-be-positioned portion with the second positioning portion, and rotation of the second side member about the second positioning portion is restricted by engagement of the second rotation to-be-stopped portion with the second rotation stopping portion, wherein the first fixing member is fastened to the first positioning portion or the first rotation stopping portion, and the first fixing member is disposed to hold the first side member between the frame and the first fixing member, wherein the second fixing member is fastened to the second positioning portion or the second rotation stopping portion, and the second fixing member is disposed to hold the second side member between the frame and the second fixing member, wherein at least either one of (1-i) the first to-be-positioned portion and the first positioning portion and (1-ii) the first rotation to-be-stopped portion and the first rotation stopping portion is adhesively bonded, and wherein at least either one of (2-i) the second to-be-positioned portion and the second positioning portion and (2-ii) the second rotation to-be-stopped portion and the second rotation stopping portion is adhesively bonded, the method comprising:

detaching at least either one of the drum unit and the developing unit by deforming the frame with the first side member and the second side member adhesively bonded to the frame.

14. A method for disassembling a cartridge, wherein the cartridge includes:

a drum unit including a photosensitive unit, a charging member configured to charge the photosensitive unit, a developing unit including a developing roller configured to develop an electrostatic latent image formed on the photosensitive unit, and a frame unit including a frame, a first side member, a second side member, a first fixing member, and a second fixing member, wherein the frame includes a first end, a second end disposed opposite the first end in a first direction, a first positioning portion disposed on the first end, a first rotation stopping portion disposed on the first end, a second positioning portion disposed on the second end, and a second rotation stopping portion disposed on the second end, wherein the first side member is attached to the first end and includes a first to-be-positioned portion configured to be engaged with the first positioning portion, a first rotation to-be-stopped portion configured to be engaged with the first rotation stopping portion, a first drum support portion configured to support the drum unit, and a first developing support portion configured to support the developing unit, wherein movement of the first side member in a direction intersecting the first direction is restricted by engagement of the first to-be-positioned portion with the first positioning portion, and rotation of the first side member about the first positioning portion is restricted by engagement of the first rotation to-be-stopped portion with the first rotation stopping portion, wherein the second side member is attached to the second end and includes a second to-be-positioned portion configured to be engaged with the second positioning portion, a second rotation to-be-stopped portion configured to be engaged with the second rotation stopping portion, a second drum support portion configured to support the drum unit, and a second developing support portion configured to support the developing unit, wherein movement of the second side member in the direction intersecting the first direction is restricted by engagement of the second to-be-positioned portion with the second positioning portion, and rotation of the second side member about the second positioning portion is restricted by engagement of the second rotation to-be-stopped portion with the second rotation stopping portion, wherein the first fixing member is fastened to the first positioning portion or the first rotation stopping portion, and the first fixing member is disposed to hold the first side member between the frame and the first fixing member, wherein the second fixing member is fastened to the second positioning portion or the second rotation stopping portion, and the second fixing member is disposed to hold the second side member between the frame and the second fixing member, wherein at least either one of (1-i) the first to-be-positioned portion and the first positioning portion and (1-ii) the first rotation to-be-stopped portion and the first rotation stopping portion is adhesively bonded, and wherein at least either one of (2-i) the second to-be-positioned portion and the second positioning portion and (2-ii) the second rotation to-be-stopped portion and the second rotation stopping portion is adhesively bonded, the method comprising:

detaching at least either one of the drum unit and the developing unit by cutting the frame unit apart.

* * * * *